US007997006B2

(12) United States Patent
Son et al.

(10) Patent No.: US 7,997,006 B2
(45) Date of Patent: Aug. 16, 2011

(54) LAUNDRY MACHINE AND CONTROL METHOD THEREOF

(75) Inventors: Chang Woo Son, Changwon-si (KR); Sang Hun Bae, Changwon-si (KR); Chul Jin Choi, Changwon-si (KR); Dong Hyun Kim, Changwon-si (KR); Young Bok Son, Changwon-si (KR); Heung Jae Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 958 days.

(21) Appl. No.: 11/980,736

(22) Filed: Oct. 31, 2007

(65) Prior Publication Data

US 2008/0168679 A1 Jul. 17, 2008

(30) Foreign Application Priority Data

Jan. 12, 2007 (KR) ..... 10-2007-0003716

(51) Int. Cl.
*F26B 11/03* (2006.01)

(52) U.S. Cl. ..... 34/381; 34/413; 34/497; 34/527; 34/587; 68/18 R; 68/53; 8/149.1; 8/142; 165/186; 510/514; 528/359; 134/30

(58) Field of Classification Search ..... 34/381, 34/413, 497, 527, 587; 528/359; 510/514; 134/30; 8/142, 149.1; 68/18 R, 53; 165/186
See application file for complete search history.

(56) References Cited

U.S. PATENT DOCUMENTS 1,338,696 A * 5/1920 Power ..... 34/606
1,398,490 A * 11/1921 Kendrick ..... 34/82
1,549,537 A 8/1925 Hansen
1,567,709 A * 12/1925 Carroll ..... 34/528
1,601,431 A * 9/1926 Ducasse ..... 34/605
1,786,191 A * 12/1930 Carroll ..... 34/485
1,909,384 A * 5/1933 White ..... 68/18 C
1,965,480 A * 7/1934 Stramaglia ..... 34/599
1,998,912 A * 4/1935 Troy ..... 198/603
RE19,986 E * 5/1936 Silver ..... 68/18 R
2,050,625 A * 8/1936 Orr ..... 34/527
2,114,776 A * 4/1938 Davis ..... 68/18 R
2,506,476 A * 5/1950 Troy ..... 34/586
2,523,305 A * 9/1950 Johnson ..... 68/53
2,595,663 A * 5/1952 Howland ..... 34/562
2,687,578 A * 8/1954 Richterkessing ..... 34/127
2,712,182 A * 7/1955 Vetorino ..... 34/82
2,758,461 A * 8/1956 Tann ..... 68/19.1
2,920,471 A * 1/1960 Barros ..... 68/20
2,927,379 A * 3/1960 Tann ..... 34/95
2,929,674 A * 3/1960 Tann ..... 8/159
3,020,648 A * 2/1962 Strike ..... 34/599

(Continued)

FOREIGN PATENT DOCUMENTS

CN 1580359 A 2/2005

(Continued)

*Primary Examiner* — Stephen M. Gravini
(74) *Attorney, Agent, or Firm* — McKenna Long & Aldridge LLP

(57) ABSTRACT

The present invention relates to a laundry machine and a control method thereof. The control method includes supplying steam, generated by a steam generator, into a drum, and supplying hot air into the drum to dry clothes wetted by the steam. According to the present invention, it is possible to effectively removing wrinkles on clothes.

19 Claims, 29 Drawing Sheets

U.S. PATENT DOCUMENTS

| | | | | |
|---|---|---|---|---|
| 3,032,887 | A * | 5/1962 | Whyte et al. | 34/524 |
| 3,066,423 | A * | 12/1962 | Solem | 34/86 |
| 3,121,000 | A * | 2/1964 | Hubbard | 34/75 |
| 3,242,584 | A * | 3/1966 | Jacobs | 34/448 |
| 3,256,617 | A * | 6/1966 | Konstandt | 34/661 |
| 3,285,589 | A * | 11/1966 | Worst | 432/43 |
| 3,402,576 | A * | 9/1968 | Krupsky | 68/4 |
| 3,601,292 | A | 8/1971 | Bliss | |
| 3,619,919 | A | 11/1971 | McMillian | |
| 3,643,341 | A * | 2/1972 | Magin | 34/444 |
| 3,651,580 | A * | 3/1972 | Meyer | 34/602 |
| 3,808,846 | A * | 5/1974 | Fleissner | 68/19.1 |
| 3,811,202 | A * | 5/1974 | Arendt | 34/599 |
| 3,826,682 | A * | 7/1974 | Liebowitz et al. | 427/242 |
| 3,866,333 | A * | 2/1975 | Sarukahanian et al. | 34/75 |
| 4,003,136 | A * | 1/1977 | Vincent et al. | 34/385 |
| 4,065,253 | A * | 12/1977 | Bullock | 432/105 |
| 4,106,214 | A * | 8/1978 | Schmidt | 34/86 |
| 4,137,645 | A * | 2/1979 | Bullock | 34/467 |
| 4,167,594 | A * | 9/1979 | Schwadtke et al. | 427/242 |
| 4,237,622 | A * | 12/1980 | Francis | 34/147 |
| 4,267,643 | A * | 5/1981 | Haried | 34/553 |
| 4,268,247 | A * | 5/1981 | Freze | 432/21 |
| 4,285,219 | A * | 8/1981 | Grunewald | 68/19.2 |
| 4,338,730 | A * | 7/1982 | Tatsumi et al. | 34/569 |
| 4,414,765 | A * | 11/1983 | Kreinberg et al. | 38/54 |
| 4,520,577 | A * | 6/1985 | Suissa | 34/76 |
| 4,599,814 | A * | 7/1986 | Geiger | 38/51 |
| 4,622,039 | A * | 11/1986 | Merenda | 8/142 |
| 4,652,390 | A * | 3/1987 | Strampach et al. | 510/295 |
| 4,735,738 | A * | 4/1988 | Willman | 510/330 |
| 4,761,305 | A * | 8/1988 | Ochiai | 427/180 |
| 4,781,041 | A * | 11/1988 | Fowler | 68/18 F |
| 4,797,128 | A * | 1/1989 | Fowler | 8/137 |
| 4,797,656 | A * | 1/1989 | Keppler | 340/539.26 |
| 4,800,655 | A * | 1/1989 | Mori et al. | 34/77 |
| 4,936,920 | A * | 6/1990 | Keritsis et al. | 131/77 |
| 5,042,524 | A | 8/1991 | Lund | |
| 5,050,259 | A * | 9/1991 | Tsubaki et al. | 8/159 |
| 5,050,313 | A * | 9/1991 | Wakaeya et al. | 34/454 |
| 5,107,606 | A * | 4/1992 | Tsubaki et al. | 34/596 |
| 5,212,969 | A * | 5/1993 | Tsubaki et al. | 68/19.2 |
| 5,289,703 | A * | 3/1994 | Hiyashi et al. | 68/24 |
| 5,343,632 | A * | 9/1994 | Dinh | 34/507 |
| 5,367,787 | A * | 11/1994 | Ikeda et al. | 34/549 |
| 5,376,144 | A * | 12/1994 | McClain et al. | 8/116.4 |
| 5,443,541 | A * | 8/1995 | St. Louis | 34/486 |
| 5,477,623 | A * | 12/1995 | Tomizawa et al. | 34/58 |
| 5,546,678 | A * | 8/1996 | Dhaemers | 34/275 |
| 5,557,704 | A * | 9/1996 | Dennis et al. | 392/480 |
| 5,600,975 | A * | 2/1997 | McClain et al. | 68/5 C |
| 5,621,370 | A * | 4/1997 | St. Louis | 337/380 |
| 5,673,497 | A * | 10/1997 | St. Louis | 34/486 |
| 5,704,230 | A * | 1/1998 | McClain et al. | 68/5 C |
| 5,709,201 | A * | 1/1998 | Puett, Jr. | 126/247 |
| 5,789,368 | A * | 8/1998 | You et al. | 510/297 |
| 5,840,675 | A * | 11/1998 | Yeazell | 510/417 |
| 5,863,299 | A * | 1/1999 | Holt et al. | 8/142 |
| 5,872,090 | A * | 2/1999 | You et al. | 510/284 |
| 5,891,197 | A * | 4/1999 | Young et al. | 8/137 |
| 5,943,720 | A * | 8/1999 | Chung | 8/158 |
| 5,979,435 | A * | 11/1999 | Puett, Jr. | 126/247 |
| 6,161,306 | A * | 12/2000 | Clodic | 34/321 |
| 6,184,193 | B1 * | 2/2001 | Yamada | 510/291 |
| 6,233,771 | B1 * | 5/2001 | Hortel et al. | 8/150 |
| 6,243,969 | B1 * | 6/2001 | Yeazell | 34/340 |
| 6,262,009 | B1 * | 7/2001 | Rogers et al. | 510/439 |
| 6,324,771 | B1 * | 12/2001 | McAllister et al. | 34/595 |
| 6,434,857 | B1 * | 8/2002 | Anderson et al. | 34/595 |
| 6,514,924 | B1 * | 2/2003 | Van Hauwermeiren et al. | 510/284 |
| 6,576,323 | B2 * | 6/2003 | Wise et al. | 428/156 |
| 6,585,781 | B1 * | 7/2003 | Roseen | 8/149.1 |
| 6,673,121 | B2 * | 1/2004 | Mettlach et al. | 8/149.1 |
| 6,684,440 | B1 * | 2/2004 | Wise et al. | 8/158 |
| 6,691,536 | B2 * | 2/2004 | Severns et al. | 68/12.27 |
| 6,745,496 | B2 * | 6/2004 | Cassella | 34/621 |
| 6,759,006 | B1 * | 7/2004 | Siklosi et al. | 422/28 |
| 6,796,055 | B2 * | 9/2004 | Baltes | 34/449 |
| 6,818,293 | B1 * | 11/2004 | Keep et al. | 428/359 |
| 6,857,296 | B2 * | 2/2005 | Fagg et al. | 68/235 R |
| 6,868,621 | B1 * | 3/2005 | Grimm et al. | 34/92 |
| 6,898,951 | B2 * | 5/2005 | Severns et al. | 68/5 C |
| 6,904,703 | B2 * | 6/2005 | Naganawa et al. | 34/596 |
| 6,916,751 | B1 * | 7/2005 | Kronzer | 442/327 |
| 6,928,752 | B2 * | 8/2005 | Johnson et al. | 34/595 |
| 6,979,495 | B2 * | 12/2005 | Keung et al. | 428/476.1 |
| 7,020,983 | B2 * | 4/2006 | Bolduan et al. | 34/506 |
| 7,066,412 | B2 * | 6/2006 | Conley et al. | 239/690 |
| 7,073,356 | B2 * | 7/2006 | Nakamura et al. | 68/12.26 |
| 7,089,768 | B2 * | 8/2006 | Bolduan et al. | 68/5 C |
| 7,162,812 | B2 * | 1/2007 | Cimetta et al. | 34/469 |
| 7,220,365 | B2 * | 5/2007 | Qu et al. | 252/70 |
| 7,275,400 | B2 * | 10/2007 | Severns et al. | 68/18 F |
| 7,305,856 | B2 * | 12/2007 | Bolduan et al. | 68/5 C |
| 7,325,330 | B2 | 2/2008 | Kim et al. | |
| 7,356,945 | B2 * | 4/2008 | Choi et al. | 34/597 |
| 7,390,778 | B1 * | 6/2008 | Strang et al. | 510/520 |
| 7,418,789 | B2 * | 9/2008 | Choi et al. | 34/380 |
| 7,481,005 | B2 * | 1/2009 | Bolduan et al. | 34/95 |
| 7,520,145 | B2 * | 4/2009 | Hong et al. | 68/12.27 |
| 7,543,396 | B2 * | 6/2009 | Nishino et al. | 34/606 |
| 7,600,402 | B2 * | 10/2009 | Shin et al. | 68/5 C |
| 7,621,155 | B2 * | 11/2009 | Ahn | 68/15 |
| 7,624,466 | B2 * | 12/2009 | Kim et al. | 8/159 |
| 7,647,663 | B2 * | 1/2010 | Kim et al. | 8/159 |
| 7,654,073 | B2 * | 2/2010 | Primlani | 60/39.183 |
| 7,665,227 | B2 * | 2/2010 | Wright et al. | 34/339 |
| 7,735,345 | B2 * | 6/2010 | Wright et al. | 68/13 R |
| 7,814,770 | B2 * | 10/2010 | Jeon et al. | 68/13 R |
| 7,882,716 | B2 * | 2/2011 | Noro et al. | 68/18 C |
| 7,895,770 | B2 * | 3/2011 | Bae et al. | 34/595 |
| 7,905,120 | B2 * | 3/2011 | Mamiya et al. | 68/5 C |
| 7,914,607 | B2 * | 3/2011 | Moschutz et al. | 95/126 |
| 7,921,578 | B2 * | 4/2011 | McAllister et al. | 34/597 |
| 7,930,838 | B2 * | 4/2011 | Bae et al. | 34/597 |
| 7,934,279 | B2 * | 5/2011 | Son | 8/158 |
| 7,942,025 | B1 * | 5/2011 | Musone | 68/20 |
| 2001/0022007 | A1 * | 9/2001 | Yeazell | 8/142 |
| 2001/0055692 | A1 * | 12/2001 | Heffelfinger et al. | 428/516 |
| 2002/0073491 | A1 * | 6/2002 | Mettlach et al. | 8/149.1 |
| 2002/0133886 | A1 * | 9/2002 | Severns et al. | 8/142 |
| 2002/0133969 | A1 * | 9/2002 | Cassella | 34/201 |
| 2002/0155308 | A1 * | 10/2002 | Heffelfinger et al. | 428/475.8 |
| 2002/0184715 | A1 * | 12/2002 | Taylor | 8/142 |
| 2003/0000106 | A1 * | 1/2003 | Anderson et al. | 34/598 |
| 2003/0017958 | A1 * | 1/2003 | Wise et al. | 510/439 |
| 2003/0061841 | A1 * | 4/2003 | Nakamura et al. | 68/12.26 |
| 2003/0066638 | A1 * | 4/2003 | Qu et al. | 165/186 |
| 2003/0087781 | A1 * | 5/2003 | Van Hauwermeiren et al. | 510/214 |
| 2003/0224965 | A1 * | 12/2003 | Conley et al. | 512/1 |
| 2003/0233766 | A1 * | 12/2003 | Bolduan et al. | 34/335 |
| 2004/0000068 | A1 * | 1/2004 | Bolduan et al. | 34/487 |
| 2004/0000174 | A1 * | 1/2004 | Bolduan et al. | 68/5 D |
| 2004/0000175 | A1 * | 1/2004 | Bolduan et al. | 68/5 D |
| 2004/0010937 | A1 * | 1/2004 | Naganawa et al. | 34/595 |
| 2004/0038842 | A1 * | 2/2004 | Fagg et al. | 510/295 |
| 2004/0045187 | A1 * | 3/2004 | Curry et al. | 34/595 |
| 2004/0064966 | A1 * | 4/2004 | Baltes | 34/443 |
| 2004/0112095 | A1 * | 6/2004 | Bolduan et al. | 68/5 C |
| 2004/0129032 | A1 * | 7/2004 | Severns et al. | 68/5 C |
| 2004/0194339 | A1 * | 10/2004 | Johnson et al. | 34/595 |
| 2004/0214984 | A1 * | 10/2004 | Keep et al. | 528/359 |
| 2005/0000033 | A1 * | 1/2005 | Park et al. | 8/159 |
| 2005/0014673 | A1 * | 1/2005 | Kwitkowski et al. | 510/515 |
| 2005/0034248 | A1 | 2/2005 | Oh | |
| 2005/0050644 | A1 * | 3/2005 | Severns et al. | 8/115.51 |
| 2005/0050756 | A1 * | 3/2005 | Casella | 34/218 |
| 2005/0081308 | A1 * | 4/2005 | Kim et al. | 8/158 |
| 2005/0092035 | A1 * | 5/2005 | Shin et al. | 68/275 |
| 2005/0172511 | A1 * | 8/2005 | Cimetta et al. | 34/607 |
| 2005/0217035 | A1 * | 10/2005 | Steiner et al. | 8/149.3 |
| 2005/0223503 | A1 * | 10/2005 | Hong et al. | 8/158 |
| 2005/0223504 | A1 * | 10/2005 | Lee et al. | 8/158 |
| 2005/0262644 | A1 * | 12/2005 | Oak et al. | 8/158 |

2005/0278983 A1* 12/2005 Rydberg ..... 38/14
2006/0005571 A1 1/2006 Lifson et al.
2006/0005581 A1 1/2006 Banba
2006/0016020 A1* 1/2006 Park ..... 8/158
2006/0086001 A1* 4/2006 Jeong et al. ..... 34/606
2006/0090524 A1* 5/2006 Jeon et al. ..... 68/135
2006/0101588 A1* 5/2006 Park et al. ..... 8/158
2006/0112585 A1* 6/2006 Choi et al. ..... 34/73
2006/0117596 A1* 6/2006 Kim et al. ..... 34/607
2006/0130354 A1* 6/2006 Choi et al. ..... 34/73
2006/0137105 A1* 6/2006 Hong et al. ..... 8/147
2006/0137107 A1* 6/2006 Lee et al. ..... 8/149.3
2006/0150689 A1* 7/2006 Kim et al. ..... 68/236
2006/0151009 A1* 7/2006 Kim et al. ..... 134/42
2006/0194712 A1* 8/2006 Conley et al. ..... 512/2
2006/0201209 A1* 9/2006 Lee et al. ..... 68/5 C
2006/0254082 A1* 11/2006 Kim ..... 34/595
2006/0277690 A1* 12/2006 Pyo et al. ..... 8/149.2
2007/0062513 A1* 3/2007 Gagas ..... 126/299 D
2007/0101773 A1* 5/2007 Park et al. ..... 68/5 C
2007/0151041 A1* 7/2007 McAllister et al. ..... 8/149.2
2007/0151129 A1* 7/2007 McAllister et al. ..... 38/3
2007/0151310 A1* 7/2007 Wright et al. ..... 68/3 R
2007/0151311 A1* 7/2007 McAllister et al. ..... 68/3 R
2007/0151312 A1* 7/2007 Bruce et al. ..... 68/3 R
2007/0163093 A1* 7/2007 Wright et al. ..... 28/100
2007/0163094 A1* 7/2007 Wright et al. ..... 28/100
2007/0163095 A1* 7/2007 McAllister et al. ..... 28/100
2007/0163096 A1* 7/2007 McAllister et al. ..... 28/100
2007/0163097 A1* 7/2007 Metcalfe et al. ..... 28/100
2007/0163098 A1* 7/2007 Tomasi et al. ..... 28/100
2007/0180728 A1* 8/2007 Kim et al. ..... 34/88
2007/0186593 A1* 8/2007 Ahn ..... 68/5 R
2007/0199352 A1* 8/2007 Saal et al. ..... 68/13 R
2007/0227030 A1* 10/2007 Oh et al. ..... 34/60
2007/0261715 A1* 11/2007 Lee et al. ..... 134/30
2007/0266587 A1* 11/2007 Bringewatt et al. ..... 34/134
2008/0000098 A1* 1/2008 Choi et al. ..... 34/114
2008/0026131 A1* 1/2008 Benjamin et al. ..... 426/660
2008/0034808 A1* 2/2008 Cho ..... 68/12.21
2008/0052950 A1* 3/2008 Park et al. ..... 34/524
2008/0053162 A1* 3/2008 Park et al. ..... 68/13 R
2008/0053164 A1* 3/2008 Park et al. ..... 68/13 R
2008/0053166 A1* 3/2008 Lim ..... 68/5
2008/0099051 A1* 5/2008 Kim et al. ..... 134/18
2008/0099052 A1* 5/2008 Lee et al. ..... 134/18
2008/0115380 A1* 5/2008 Nishino et al. ..... 34/58
2008/0115381 A1* 5/2008 Bae et al. ..... 34/60
2008/0115540 A1* 5/2008 Nishino et al. ..... 68/12.08
2008/0141550 A1* 6/2008 Bae et al. ..... 34/68
2008/0141552 A1* 6/2008 Bae et al. ..... 34/108
2008/0141553 A1* 6/2008 Son et al. ..... 34/130
2008/0141554 A1* 6/2008 Bae et al. ..... 34/132
2008/0141557 A1* 6/2008 Son et al. ..... 34/565
2008/0141558 A1* 6/2008 Bae et al. ..... 34/595
2008/0141734 A1* 6/2008 Son et al. ..... 68/5 C
2008/0148494 A1* 6/2008 Son et al. ..... 8/149.3
2008/0148596 A1* 6/2008 Son et al. ..... 34/486
2008/0168679 A1* 7/2008 Son et al. ..... 34/497
2008/0196410 A1* 8/2008 Primlani ..... 60/641.15
2008/0209757 A1* 9/2008 Park et al. ..... 34/389
2008/0250822 A1* 10/2008 Ahn ..... 68/5 C
2008/0256720 A1* 10/2008 Park et al. ..... 8/149.3
2008/0256989 A1* 10/2008 Jeong et al. ..... 68/5 C
2008/0263783 A1* 10/2008 Pyo ..... 8/149.3
2008/0271263 A1* 11/2008 Bae et al. ..... 8/159
2008/0271500 A1* 11/2008 Ahn ..... 68/5 C
2008/0272934 A1* 11/2008 Wang et al. ..... 340/870.11
2008/0276381 A1* 11/2008 Son ..... 8/149.3
2008/0276659 A1* 11/2008 Bae et al. ..... 68/5 C
2008/0276660 A1* 11/2008 Bae et al. ..... 68/5 C
2008/0276661 A1* 11/2008 Bae et al. ..... 68/5 C
2008/0282751 A1* 11/2008 Yoon et al. ..... 68/5 C
2008/0289212 A1* 11/2008 Moon et al. ..... 34/267
2008/0302138 A1* 12/2008 Bae et al. ..... 68/12.05
2008/0313922 A1* 12/2008 Bae et al. ..... 34/491
2009/0025557 A1* 1/2009 Moschutz et al. ..... 95/148
2009/0038084 A1* 2/2009 Lee et al. ..... 8/149.1
2009/0049872 A1* 2/2009 Noro et al. ..... 68/18 C
2009/0049874 A1* 2/2009 Mamiya et al. ..... 68/5 C
2009/0064421 A1* 3/2009 Lee et al. ..... 8/137
2009/0064725 A1* 3/2009 Lim et al. ..... 68/139
2009/0071032 A1* 3/2009 Kreutzfeldt et al. ..... 34/389
2009/0077755 A1* 3/2009 Park et al. ..... 8/137
2009/0078007 A1* 3/2009 Bae et al. ..... 68/5 C
2009/0083988 A1* 4/2009 Yoon et al. ..... 34/130
2009/0083990 A1* 4/2009 Bae et al. ..... 34/486
2009/0095032 A1* 4/2009 Lee ..... 68/5 C
2009/0100882 A1* 4/2009 Bae et al. ..... 68/5 C
2009/0113745 A1* 5/2009 Choi et al. ..... 34/139
2009/0113755 A1* 5/2009 Choi et al. ..... 34/390
2009/0113944 A1* 5/2009 Kim et al. ..... 68/5 C
2009/0120140 A1* 5/2009 Choi et al. ..... 68/5 C
2009/0126222 A1* 5/2009 Bae et al. ..... 34/527
2009/0126421 A1* 5/2009 Kim et al. ..... 68/5 C
2009/0126423 A1* 5/2009 Bae et al. ..... 68/5 C
2009/0133281 A1* 5/2009 Yoon et al. ..... 34/72
2009/0133298 A1* 5/2009 Kim et al. ..... 38/14
2009/0139037 A1* 6/2009 Jeong et al. ..... 8/149.3
2009/0139277 A1* 6/2009 Park et al. ..... 68/5 C
2009/0159301 A1* 6/2009 Chatot et al. ..... 169/56
2009/0172967 A1* 7/2009 Son et al. ..... 34/318
2009/0183532 A1* 7/2009 Kim et al. ..... 68/5 R
2009/0193592 A1* 8/2009 Stefanich et al. ..... 8/137
2009/0199424 A1* 8/2009 Bae et al. ..... 34/60
2009/0201124 A1* 8/2009 Kim et al. ..... 340/3.71
2009/0211109 A1* 8/2009 Choi et al. ..... 34/491
2009/0235553 A1* 9/2009 Bae et al. ..... 34/524
2009/0235555 A1* 9/2009 Jie Bo ..... 34/557
2009/0241606 A1* 10/2009 Yoo et al. ..... 68/5 C
2009/0249639 A1* 10/2009 Kim et al. ..... 34/389
2009/0249839 A1* 10/2009 Moon et al. ..... 68/5 C
2009/0255146 A1* 10/2009 Klug et al. ..... 34/491
2009/0255299 A1* 10/2009 Hiro et al. ..... 68/19
2009/0260246 A1* 10/2009 Bae et al. ..... 34/60
2009/0260250 A1* 10/2009 Moon et al. ..... 34/202
2009/0265953 A1* 10/2009 Bae et al. ..... 34/467
2009/0277035 A1* 11/2009 Choi et al. ..... 34/130
2009/0277036 A1* 11/2009 Lee et al. ..... 34/215
2009/0277037 A1* 11/2009 Lim ..... 34/215
2009/0282695 A1* 11/2009 Kreutzfeldt et al. ..... 34/443
2009/0282696 A1* 11/2009 Kim et al. ..... 34/493
2009/0288456 A1* 11/2009 Bae et al. ..... 68/5 R
2009/0307921 A1* 12/2009 Bae et al. ..... 34/60
2009/0320213 A1* 12/2009 Lee et al. ..... 8/159
2009/0320313 A1* 12/2009 Bae et al. ..... 34/132
2009/0320314 A1* 12/2009 Jo et al. ..... 34/218
2009/0320318 A1* 12/2009 Kim et al. ..... 34/428
2009/0320530 A1* 12/2009 Kim et al. ..... 68/12.27
2010/0000117 A1* 1/2010 Choi et al. ..... 34/443
2010/0000269 A1* 1/2010 Shin et al. ..... 68/5 C
2010/0005598 A1* 1/2010 Jung ..... 8/159
2010/0005681 A1* 1/2010 Jo et al. ..... 34/215
2010/0018072 A1* 1/2010 Kim et al. ..... 34/86
2010/0018262 A1* 1/2010 Beihoff et al. ..... 68/5 C
2010/0024243 A1* 2/2010 Ricklefs et al. ..... 34/474
2010/0043245 A1* 2/2010 Noviello ..... 34/60
2010/0050464 A1* 3/2010 Krzelowski et al. ..... 34/380
2010/0050465 A1* 3/2010 Im et al. ..... 34/380
2010/0058608 A1* 3/2010 Moon et al. ..... 34/282
2010/0058610 A1* 3/2010 Kim et al. ..... 34/474
2010/0058814 A1* 3/2010 Kim et al. ..... 68/12.23
2010/0058815 A1* 3/2010 Lim et al. ..... 68/15
2010/0077628 A1* 4/2010 Bae et al. ..... 34/60
2010/0077801 A1* 4/2010 Son et al. ..... 68/20
2010/0083445 A1* 4/2010 Kim et al. ..... 8/159
2010/0083711 A1* 4/2010 Han et al. ..... 68/13 R
2010/0095716 A1* 4/2010 Bae et al. ..... 68/5 R
2010/0101280 A1* 4/2010 Im et al. ..... 68/19
2010/0107433 A1* 5/2010 Paruzzolo et al. ..... 34/73
2010/0115784 A1* 5/2010 Jo et al. ..... 34/132
2010/0115785 A1* 5/2010 Ben-Shmuel et al. ..... 34/260
2010/0115788 A1* 5/2010 Kim et al. ..... 34/443
2010/0115790 A1* 5/2010 Arreghini ..... 34/570
2010/0139334 A1* 6/2010 Kim et al. ..... 68/5 C
2010/0141013 A1* 6/2010 Lahr ..... 299/16
2010/0147040 A1* 6/2010 Kim et al. ..... 68/5 C
2010/0154250 A1* 6/2010 Bae et al. ..... 34/549

| | | | | |
|---|---|---|---|---|
| 2010/0180465 | A1* | 7/2010 | Noviello et al. | 34/467 |
| 2010/0186176 | A1* | 7/2010 | Wright et al. | 8/137 |
| 2010/0206016 | A1* | 8/2010 | Bae et al. | 68/5 C |
| 2010/0229607 | A1* | 9/2010 | Persson et al. | 68/19 |
| 2010/0236001 | A1* | 9/2010 | Lee et al. | 8/159 |
| 2010/0257902 | A1* | 10/2010 | Persson et al. | 68/20 |
| 2010/0269266 | A1* | 10/2010 | Lee et al. | 8/159 |
| 2010/0281929 | A1* | 11/2010 | Han et al. | 68/5 C |
| 2011/0005276 | A1* | 1/2011 | Moon et al. | 68/6 |
| 2011/0016743 | A1* | 1/2011 | Jung et al. | 34/428 |
| 2011/0016928 | A1* | 1/2011 | Beihoff et al. | 68/19 |
| 2011/0023321 | A1* | 2/2011 | Jung | 34/418 |
| 2011/0030147 | A1* | 2/2011 | Yoo et al. | 8/137 |
| 2011/0030427 | A1* | 2/2011 | Santarossa et al. | 68/5 C |
| 2011/0030428 | A1* | 2/2011 | Han et al. | 68/5 R |
| 2011/0032072 | A1* | 2/2011 | Han et al. | 340/5.1 |
| 2011/0041258 | A1* | 2/2011 | Ko et al. | 8/137 |
| 2011/0050441 | A1* | 3/2011 | Han et al. | 340/679 |
| 2011/0054843 | A1* | 3/2011 | Han et al. | 702/185 |
| 2011/0054844 | A1* | 3/2011 | Han et al. | 702/185 |
| 2011/0054845 | A1* | 3/2011 | Han et al. | 702/185 |
| 2011/0054967 | A1* | 3/2011 | Han et al. | 705/7.13 |
| 2011/0060553 | A1* | 3/2011 | Han et al. | 702/185 |
| 2011/0067457 | A1* | 3/2011 | Han et al. | 68/13 R |
| 2011/0074589 | A1* | 3/2011 | Han et al. | 340/618 |
| 2011/0107617 | A1* | 5/2011 | Lee et al. | 34/427 |

FOREIGN PATENT DOCUMENTS

| | | | |
|---|---|---|---|
| CN | 1644787 | | 7/2005 |
| CN | 1696384 | | 11/2005 |
| DE | 1544345 | | 7/1969 |
| DE | 103 32 656 | A1 | 7/2004 |
| DE | 103 02 866 | | 8/2004 |
| DE | 10-2007-007354 | A1 | 10/2007 |
| EP | 0 150 728 | A2 | 8/1985 |
| EP | 1 275 767 | | 1/2003 |
| EP | 1 544 345 | A2 | 6/2005 |
| EP | 1 669 668 | | 6/2006 |
| EP | 1666655 | A2 | 6/2006 |
| EP | 1900865 | A1 * | 3/2008 |
| EP | 1932963 | A1 * | 6/2008 |
| EP | 1936021 | A2 * | 6/2008 |
| EP | 1939349 | A2 * | 7/2008 |
| EP | 2014820 | A1 * | 1/2009 |
| JP | 01175896 | A * | 7/1989 |
| JP | 01175897 | A * | 7/1989 |
| JP | 01265999 | A * | 10/1989 |
| JP | 06071093 | A * | 3/1994 |
| JP | 06-233898 | A | 8/1994 |
| JP | 07000690 | A * | 1/1995 |
| JP | 08252395 | A * | 10/1996 |
| JP | 09173697 | A * | 7/1997 |
| JP | 10192595 | A * | 7/1998 |
| JP | 11-276799 | A | 10/1999 |
| JP | 2005-83708 | | 3/2005 |
| JP | 2005130956 | A * | 5/2005 |
| JP | 2006-29649 | | 2/2006 |
| KR | 2004-0015957 | | 2/2004 |
| KR | 10-0640788 | B1 | 10/2006 |
| WO | WO 2007145432 | A1 * | 12/2007 |
| WO | WO 2007145448 | A2 * | 12/2007 |
| WO | WO 2007145451 | A2 * | 12/2007 |
| WO | WO 2008010671 | A2 * | 1/2008 |
| WO | WO 2008013426 | A2 * | 1/2008 |
| WO | WO 2008038959 | A2 * | 4/2008 |
| WO | WO 2010114332 | A2 * | 10/2010 |

* cited by examiner

LAUNDRY MACHINE AND CONTROL METHOD THEREOF

CROSS-REFERENCE TO RELATED APPLICATION

This application claims the benefit of Korean Patent Application No. 10-2007-0003716, filed on Jan. 12, 2007, which is hereby incorporated by reference in its entirety as if fully set forth herein.

BACKGROUND OF THE INVENTION

1. Field of the Invention

The present invention relates to a laundry machine and a control method thereof, and more particularly, to a laundry dryer and a control method thereof that are capable of removing or preventing wrinkles or rumples on clothes.

2. Discussion of the Related Art

A laundry machine is an electric home appliance that dries washed laundry, for example, washed clothes, using high-temperature air. Generally, the laundry machine includes a drum for receiving an object to be dried, a drive source for driving the drum, a heating unit for heating air to be introduced into the drum, and a blower unit for suctioning or discharging air into or out of the drum.

Based on how to heat air, i.e., the type of the heating unit, the laundry machine may be classified as an electric laundry machine or a gas laundry machine. The electric laundry machine heats air using electric resistance heat, whereas the gas laundry machine heats air using heat generated by the combustion of gas. In addition, the laundry machine may be classified as a condensation type laundry machine or a discharge type laundry machine. In the condensation type laundry machine, air, heat-exchanged with an object to be dried in a drum and changed into a high-humidity phase, is circulated without discharging the air out of the laundry machine. Heat exchange is performed between an additional condenser and external air to produce condensed water, which is discharged out of the laundry machine. In the discharge type laundry machine, air, heat-exchanged with an object to be dried in a drum and changed into a high-humidity phase, is directly discharged out of the laundry machine. Based on how to put laundry in the laundry machine, the laundry machine may be classified as a top loading type laundry machine or a front loading type laundry machine. In the top loading type laundry machine, an object to be dried is put in the laundry machine from above. In the front loading type laundry machine, an object to be dried is put in the laundry machine from the front.

However, the conventional laundry machine with the above-stated construction has the following problems.

Generally, laundry, which has been already washed and spin-dried, is put in a laundry machine such that the laundry is dried by the laundry machine. However, the water-washed laundry is wrinkled according to the principle of water washing, and the wrinkles on the laundry are not completely removed during the drying process performed by the laundry machine. Consequently, an additional ironing process is needed to remove wrinkles on a dried object, i.e., laundry which has been already dried by the conventional laundry machine.

Furthermore, when clothes as well as washed laundry are normally stored and used, the clothes and the washed laundry may be wrinkled, crumpled, or folded (hereinafter, generally referred to as "wrinkled"). Consequently, there is a high necessity for an apparatus that is capable of easily and conveniently removing wrinkles on clothes during the normal use and storage of the clothes.

SUMMARY OF THE INVENTION

Accordingly, the present invention is directed to a laundry machine and a control method thereof that substantially obviate one or more problems due to limitations and disadvantages of the related art.

An object of the present invention is to provide a laundry machine and a control method thereof that are capable of preventing and/or removing wrinkles or rumples on clothes.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a control method of a laundry machine includes supplying steam, generated by a steam generator, into a drum, and supplying hot air into the drum to dry clothes wetted by the steam.

Preferably, the control method further includes heating the interior of the drum before the step of supplying steam, generated by a steam generator, into a drum is carried out. Preferably, the step of heating the interior of the drum includes supplying hot air, generated by a hot air heater, into the drum. Preferably, the step of heating the interior of the drum includes operating the hot air heater a predetermined period of time after the steam generator is operated. More preferably, the step of heating the interior of the drum includes operating the hot air heater when the water level in the steam generator reaches a high water level. Also preferably, the step of heating the interior of the drum includes operating the hot air heater at a capacity less than the rated capacity of the hot air heater.

Preferably, the step of heating the interior of the drum includes stopping the operation of the hot air heater when steam is generated by the steam generator. More preferably, the step of heating the interior of the drum includes forcibly stopping the operation of the hot air heater after the hot air heater is operated for a predetermined period of time. Also preferably, the step of heating the interior of the drum includes rotating the drum.

Preferably, the step of supplying steam, generated by a steam generator, into a drum includes rotating the drum. More preferably, the drum is intermittently rotated. At this time, the stop time of the drum may be greater than the rotation time of the drum.

Preferably, the steam generator starts to heat water when the water level in the steam generator is a low water level, and the supply of water to the steam generator is stopped when the water level in the steam generator is a high water level. Also preferably, water is supplied to the steam generator for a period of time when the water level in the steam generator reaches a low water level during the supply of water.

Preferably, the control method further includes cooling the drum. Also preferably, the control method further includes collecting water remaining in the steam generator to discharge the remaining water to the outside after the step of supplying steam, generated by a steam generator, into a drum is completed. More preferably, the step of collecting water remaining in the steam generator includes pumping the remaining water in the steam generator to the outside.

Preferably, the steam supply time at the step of supplying steam, generated by a steam generator, into a drum is different from the hot air supply time at the step of supplying hot air into the drum to dry clothes wetted by the steam, depending upon a selected mode. For example, the steam supply time and the hot air supply time for sterilization may be greater than the steam supply time and the hot air supply time for removal of wrinkles. Also, the steam supply time and the hot air supply time for fluffing may be less than the steam supply time and the hot air supply time for removal of wrinkles.

According to the present invention as described above, it is possible to effectively prevent and/or remove wrinkles on clothes.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a top loading electrical condensation type laundry machine will be described as an embodiment of the present invention in order to describe a laundry machine according to the present invention and a control method thereof. However, the present invention is not limited to the above-specified laundry machine, and therefore, it is also possible to apply the present invention to a front loading gas condensation type laundry machine.

Figure 1:
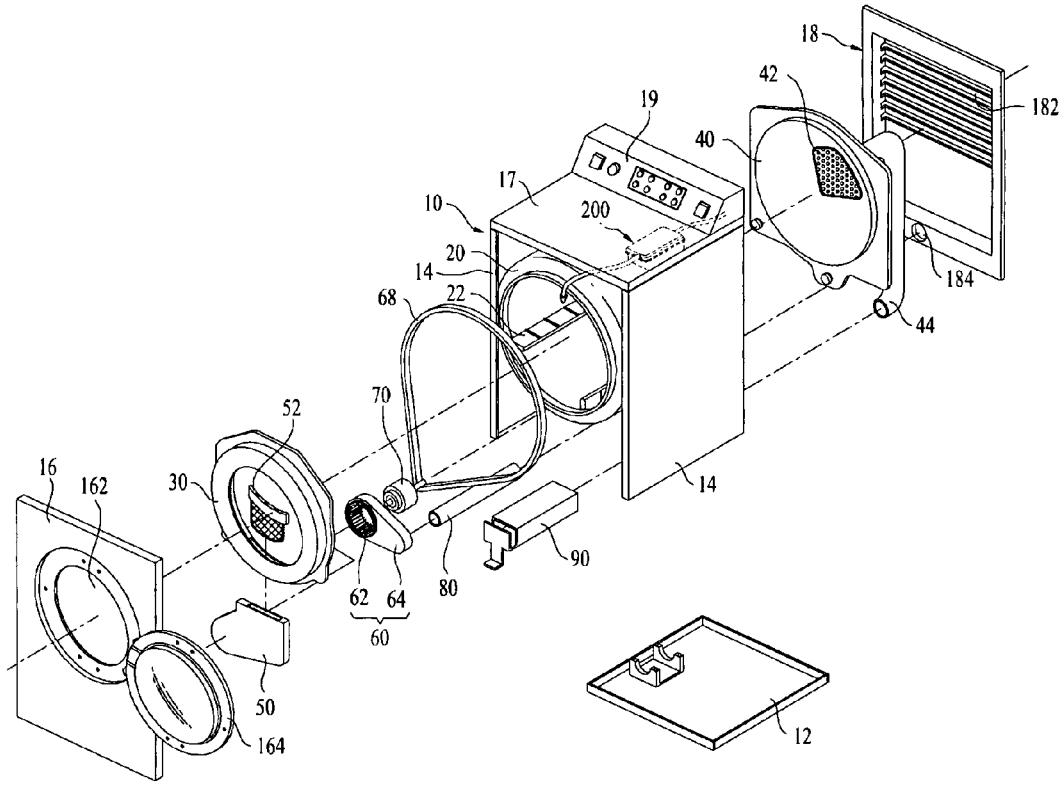
FIG. 1 is an exploded perspective view illustrating an embodiment of a laundry machine according to the present invention.
Figure 2:
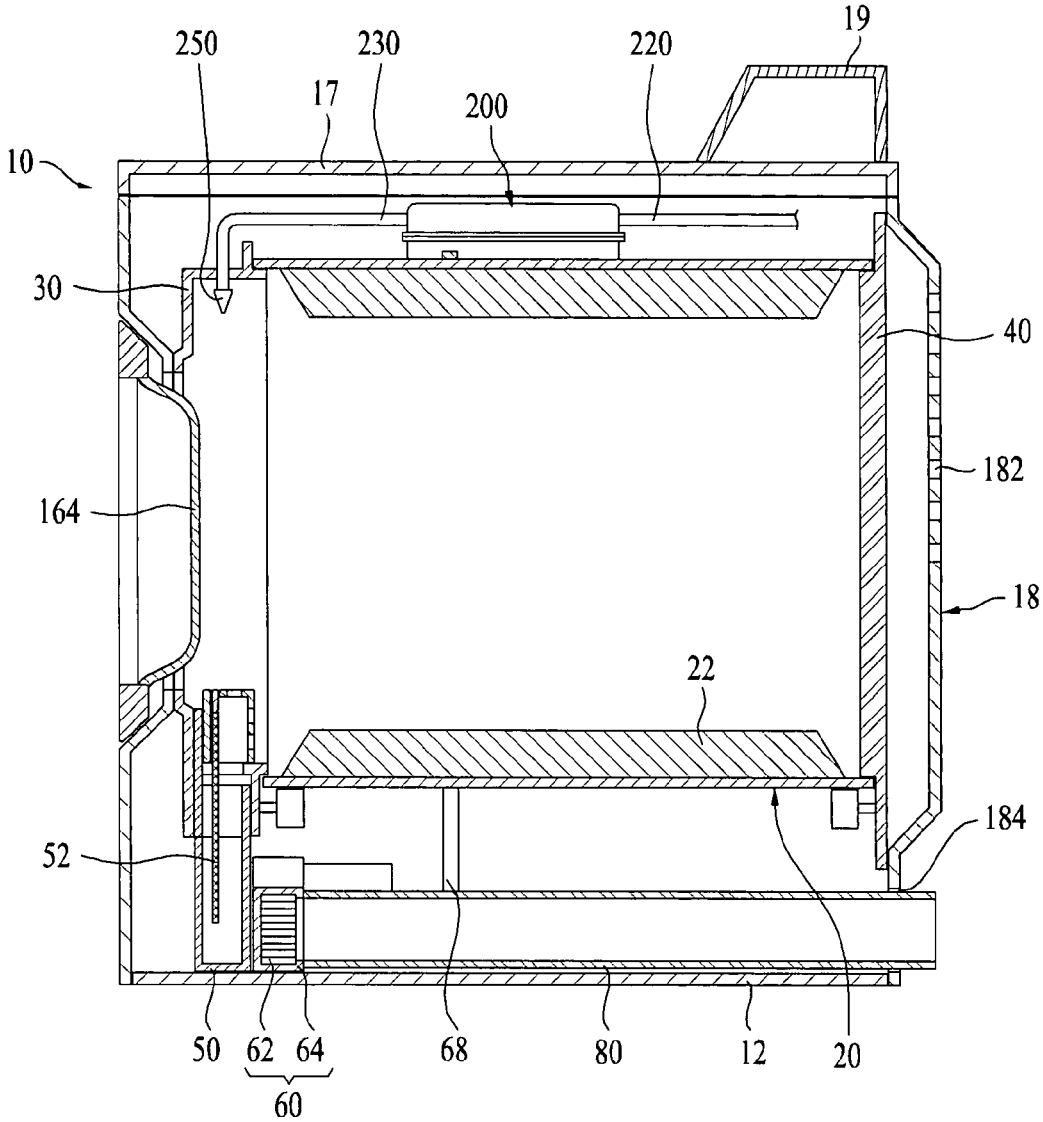
FIG. 2 is vertical sectional view of FIG. 1.

A laundry machine and a control method thereof according to an embodiment of the present invention will be described with reference to FIGS. 1 and 2.

In a cabinet 10, forming the external appearance of the laundry machine, are mounted a rotary drum 20, and a motor 70 and a belt 68 for driving the drum 20. At predetermined positions, in the cabinet 10, are mounted a heater 90 (hereinafter, referred to as a "hot air heater" for convenience of description) for heating air to generate high-temperature air (hereinafter, referred to as "hot air"), and a hot air supply duct 44 for hot air, generated by the hot air heater 90, into the drum 20. In the cabinet 10 are also mounted an exhaust duct 80 for discharging high-humidity air, heat-exchanged with an object to be dried in the drum 20, out of the drying machine, and a blower unit 60 for suctioning the high-humidity air. In addition, a steam generator 200, for generating high-temperature steam, is mounted at a predetermined position in the cabinet 10. In this embodiment, an indirect drive system, in which the drum 20 is rotated using the motor 70 and the belt 68, is illustrated and described for convenience of description. However, the present invention is not limited to the indirect drive system. For example, the present invention may be applied to a direct drive system in which the motor is directly connected to the rear of the drum 20 such that the drum 20 is directly rotated by the motor.

Now, the respective components of the laundry machine will be described in detail.

The cabinet 10 forms the external appearance of the laundry machine. The cabinet 10 includes a base 12 constituting the bottom thereof, a pair of side covers 14 mounted vertically on the base 12, a front cover 16 and a rear cover 18 mounted at the front and rear of the side covers 14, respectively, and a top cover 17 located at the top of the side covers 14. A control panel 19, having various manipulation switches, is normally disposed at the top cover 17 or the front cover 16. To the front cover 16 is mounted a door 164. The rear cover 18 is provided with a suction unit 182, through which external air is introduced, and an exhaust hole 184, which is a final channel for discharging air in the drum 20 out of the cabinet 10.

The interior space of the drum 20 serves as a drying chamber in which a drying process is carried out. Inside the drum 20 are preferably mounted lifts 22 for lifting and dropping an object to be dried, such that the object turns over, to increase the drying efficiency.

On the other hand, a front supporter 30 and a rear supporter 40 are mounted between the drum 20 and the cabinet 10, i.e., between the drum 20 and the front cover 16 and between the drum 20 and the rear cover 18, respectively. The drum 20 is rotatably mounted between the front supporter 30 and the rear supporter 40. Between the front supporter 30 and the drum 20 and between the rear supporter 40 and the drum 20 are mounted sealing members (not shown) for preventing the leakage of air, respectively. Specifically, the front supporter 30 and the rear supporter 40 enclose the front and the rear of the drum 20 to define the drying chamber. Also, the front supporter 30 and the rear supporter 40 serve to support the front end and the rear end of the drum 20, respectively.

In the front supporter 30 is formed an opening, through which the drum 20 communicates with the outside of the laundry machine. The opening is selectively opened and closed by the door 164. Also, a lint duct 50, which is a channel for discharging air in the drum 20 out of the laundry machine, is connected to the front supporter 30. In the lint duct 50 is mounted a lint filter 52. One side of the blower unit 60 is connected to the lint duct 50, and the other side of the blower unit 60 is connected to the exhaust duct 80. The exhaust duct 80 communicates with the exhaust hole 184, which is formed in the rear cover 18. Consequently, when the blower unit 60 is operated, air in the drum 20 is discharged out of the laundry machine through the lint duct 50, the exhaust duct 80, and the exhaust hole 184. At this time, foreign matter, such as lint, is filtered out by the lint filter 52. Generally, the blower unit 60 includes a blower 62 and a blower housing 64. The blower 62 is generally connected to the motor 70, which drives the drum 20.

In the rear supporter 40 is formed an opening 42 including a plurality of through-holes. The hot air supply duct 44 is connected to the opening 42. The hot air supply duct 44, communicating with the drum 20, serves as a channel for supplying hot air into the drum 20. Consequently, the hot air heater 90 is mounted at a predetermined position on the hot air supply duct 44.

Figure 3:
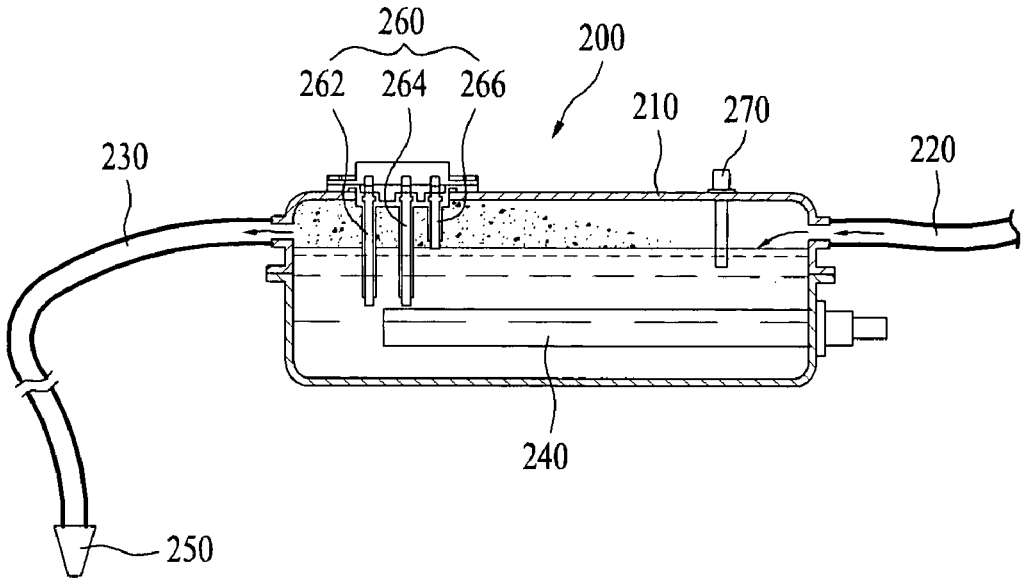
FIG. 3 is a sectional view illustrating a steam generator of FIG. 1.

On the other hand, the steam generator 200, for generating steam to be supplied into the drum 20, is mounted at a predetermined position in the cabinet 10. The details of the steam generator 200 will be described below with reference to FIG. 3.

The steam generator 200 includes a water tank 210 for storing water, a heater 240 mounted in the water tank 210, a water level sensor 260 for sensing the water level in the steam generator 200, and a temperature sensor 270 for sensing the temperature in the steam generator 200. The water level sensor 260 generally includes a common electrode 262, a low water level electrode 264, and a high water level electrode 266. The water level sensor 260 senses a high water level or a low water level in the steam generator 200 based on the current conduction between the common electrode 262 and the high water level electrode 264 or the current conduction between the common electrode 262 and the low water level electrode 266.

To one side of the steam generator 200 is connected a water supply hose 220 for supplying water. To the other side of the steam generator 200 is connected a steam hose 230 for discharging steam. To the tip end of the steam hose 230 is preferably mounted a nozzle 250, which is formed in a predetermined shape. Generally, one end of the water supply hose 220 is connected to an external water supply source, such as a faucet. The tip end of the steam hose 230 or the nozzle 250, i.e., the steam discharge port, is located at a predetermined position in the drum 20 for spraying steam into the drum 20.

In this embodiment, on the other hand, the steam generator 200 is constructed in a structure in which a predetermined amount of water stored in the water tank 210, having a predetermined size, is heated by the heater 240 to generate steam (hereinafter, referred to as a "tub heating type steam generator" for convenience of description). However, the present invention is not limited to the above-specified steam generator. Consequently, the present invention may use any steam generator so long as the steam generator is capable of generating steam. For example, the steam generator 200 may be constructed in a structure in which the heater is directly mounted around the water supply hose, through which water passes, to heat water without storing the water in a predetermined space (hereinafter, referred to as a "pipe heating type steam generator" for convenience of description).

Figure 4:
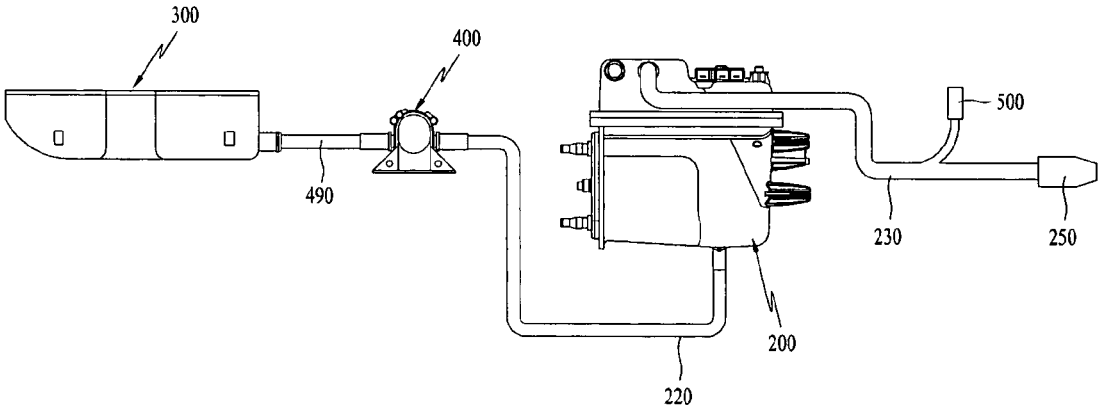
FIG. 4 is a view illustrating another embodiment of a laundry machine according to the present invention, wherein a steam generator of the laundry machine is principally shown.

Now, another embodiment of a laundry machine according to the present invention will be described with reference to FIG. 4.

In this embodiment, a water supply source 300, for supplying water to the steam generator 200, is detachably mounted to the laundry machine. As in the previous embodiment, the water supply source may be a faucet. In this case, however, the installation of the water supply source is very complicated. This is because water is not generally used in the drying machine, and therefore, when the faucet is used as the water supply source, it is necessary to install various devices, which are annexed to the faucet. In this embodiment, therefore, the detachable water supply source 300 is used. Specifically, the water supply source 300 is separated from the steam generator 200 so as to fill the water supply source 300 with water. After the water supply source 300 is filled with the water, the water supply source 300 is connected to the water supply channel of the steam generator 200, i.e., the water supply hose 220, which is very convenient.

Between the water supply source 300 and the steam generator 200 is preferably mounted a pump 400. The pump is preferably rotatable in the clockwise and counterclockwise directions. Consequently, it is possible to supply water to the steam generator 200, and, if necessary, it is possible to collect the remaining water from the steam generator 200. However, it is also possible to supply water to the steam generator 200 using a water head difference between the water supply source 300 and the steam generator 200, without using the pump 400. However, various components of the laundry machine are normally standardized articles and designed in a compact structure, with the result that the structurally available space of the laundry machine is absolutely insufficient. For this reason, the water supply using the water head difference is actually impossible if the size of various components of the conventional laundry machine is not changed. Consequently, when the small-sized pump 400 is used, it is possible to install the steam generator 200 without the change in size of various components of the conventional laundry machine, and therefore, the use of the pump 400 is very beneficial. Also, the reason to collect the remaining water from the steam generator 200 is that the heater may be damaged due to the remaining water in the steam generator 200, or decomposed water may be hereafter used, if the steam generator 200 is not used for a long period of time.

In the previous embodiment, water is supplied into the upper part of the steam generator 200, and steam is discharged from the upper part of the steam generator 200. In this embodiment, on the other hand, water is supplied into the lower part of the steam generator 200, and steam is discharged from the upper part of the steam generator 200. This structure is advantageous in collecting the remaining water from the steam generator 200.

Also, a safety valve 500 is preferably mounted on a steam channel for discharging steam from the steam generator 200, i.e., a steam hose 230.

Hereinafter, the respective components of the laundry machine will be described in detail.

Figure 5:
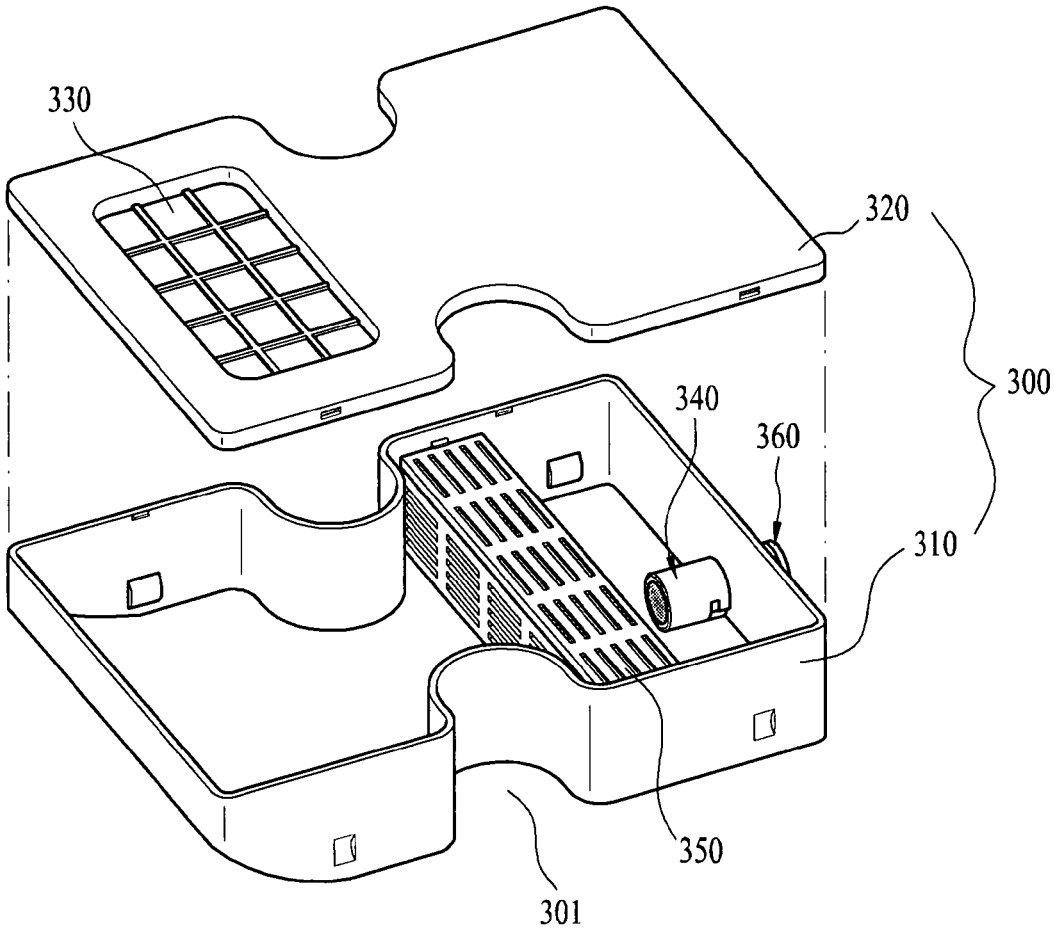
FIG. 5 is an exploded perspective view illustrating an example of a water supply source of FIG. 4.

First, the details of the detachable water supply source 300 (hereinafter, referred to as a "cartridge" for convenience of description) will be described with reference to FIG. 5.

The cartridge 300 includes a lower housing 310 for storing water and an upper housing 320 detachably mounted to the lower housing 310. When the cartridge 300 is constructed in a structure including the lower housing 310 and the upper housing 320, it is easy to clean scale accumulating in the cartridge 300. In addition, it is easy to separate filters 330 and 340 and a water softening member 350 from the upper and lower housings and to clean or regenerate the separate filters 330 and 340 and the separate water softening member 350.

A first filter 330 is preferably mounted to the upper housing 320. Specifically, the first filter 330 is mounted in a water introduction part of the upper housing 320 for primarily filtering water when the water is supplied to the cartridge 300.

To the lower housing 310 is preferably mounted an opening and closing member 360 for selectively discharging water in the cartridge 300 to the outside. Consequently, when the cartridge 300 is separated from the laundry machine, the water in the cartridge 300 is not allowed to be discharged to the outside, and, when the cartridge 300 is mounted in the laundry machine, the water in the cartridge 300 is allowed to be discharged to the outside. To the opening and closing member 360 is preferably mounted a second filter 340 for filtering water. More preferably, the second filter 340 is detachably mounted to the opening and closing member 360. By the provision of the first filter 330 and the second filter 340, it is possible to doubly filter out impurities, such as micro dust, from the water. Preferably, the first filter 330 is made of an approximately 50 mesh net, and the second filter 340 is made of an approximately 60 mesh net. Here, the 50 mesh net is a mesh net constructed in a structure in which the number of meshes per unit area is 50. Consequently, the size of pores constituting the meshes of the first filter 330 is greater than that of pores constituting the meshes of the second filter 340. As a result, large-sized articles of the foreign matter are primarily filtered out by the first filter 330, and small-sized articles of the foreign matter are secondarily filtered out by the second filter 340.

Figure 6:
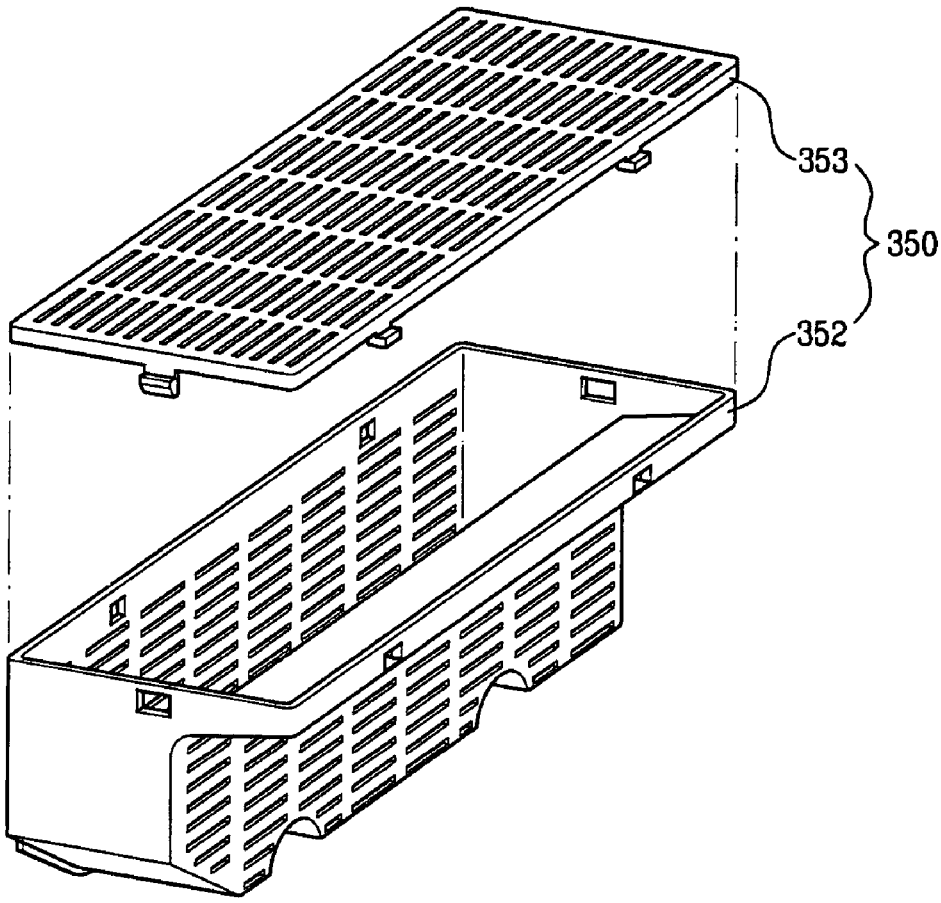
FIG. 6 is an exploded perspective view illustrating a water softening member of FIG. 5.

In the cartridge 300 is preferably mounted a water softening member 350 for softening water. More preferably, the water softening member 350 is detachably mounted in the cartridge 300. As shown in FIG. 6, the water softening member 350 includes a lower housing 352 having a plurality of through-holes and an upper housing 353 detachably mounted to the lower housing 352. The upper housing 353 has a plurality of through-holes. Preferably, a space defined between the upper housing 353 and the lower housing 352 is filled with ion-exchange resin (not shown).

The reason to use the water softening member 350 is as follows. When the hardness of water to be supplied to the steam generator 200 is high, lime, such as calcium carbonate ($CaCO_3$), may be separated as calcium hydrogencarbonate ($Ca(HCO_3)_2$), dissolved in the water, is heated, and the heater may be corroded by the lime. Especially, water in Europe and the Americas is hard water having a high hardness. For this reason, the above-mentioned phenomenon may be serious. Consequently, it is preferable to previously remove calcium and magnesium ions, using ion-exchange resin, thereby preventing the separation of lime. The efficiency of the ion-exchange resin is lowered as the water softening process is carried out. Consequently, it is possible to regenerate the ion-exchange resin, using a salt solution (NaCl), such that the ion-exchange resin can be reused. For reference, the water softening process using the ion-exchange resin is represented by 2(R—SONa)+Ca2<->(R—SO)Ca+2Na, and the regenerating process of the ion-exchange resin is represented by (R—SO)Ca+2NaCl<->2(R—SONa)+CaCl.

Figure 7A:
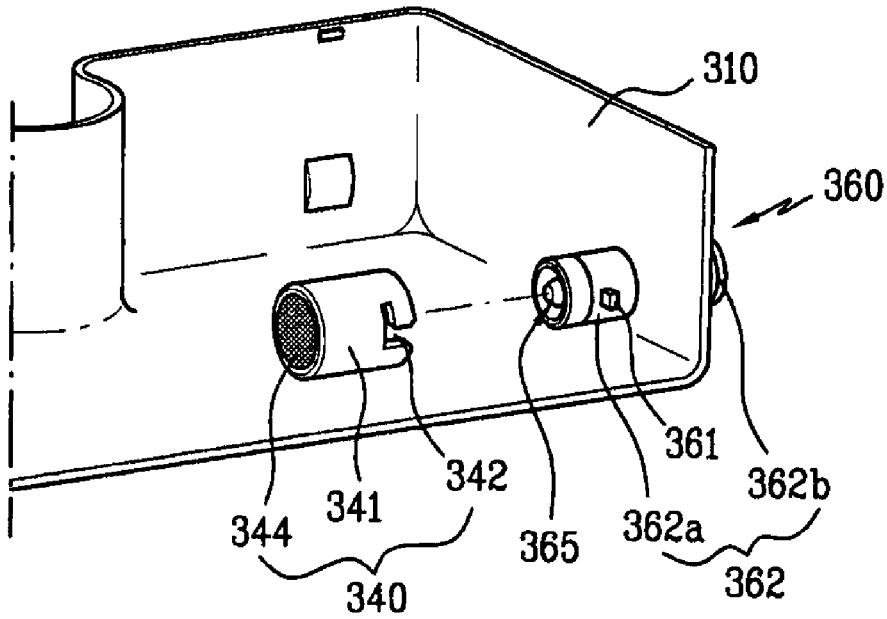
FIGS. 7A to 7C are partially cut-away perspective views of FIG. 5.
Figure 7B:
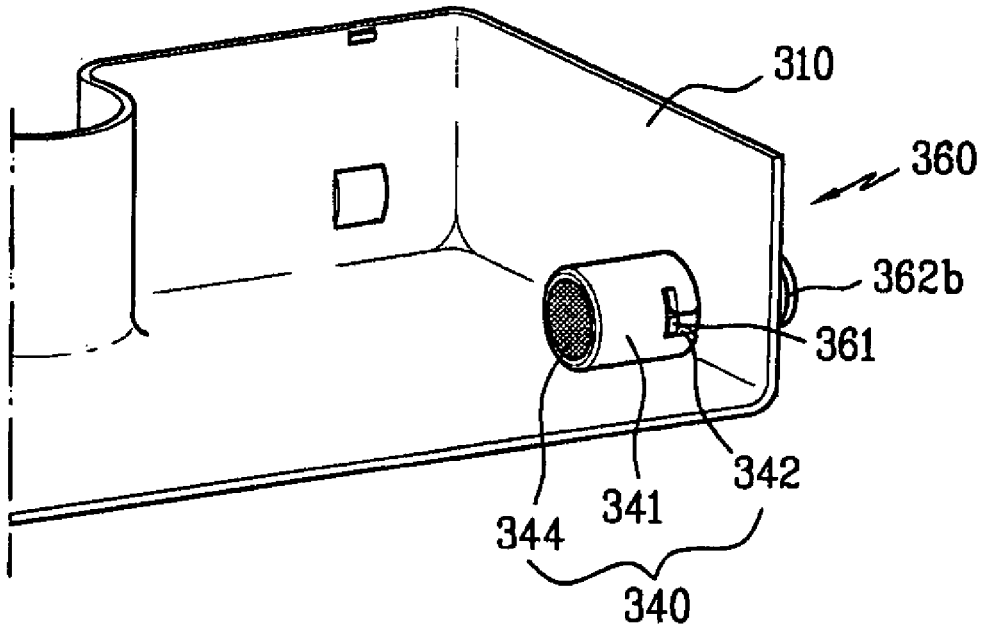
Figure 7C:
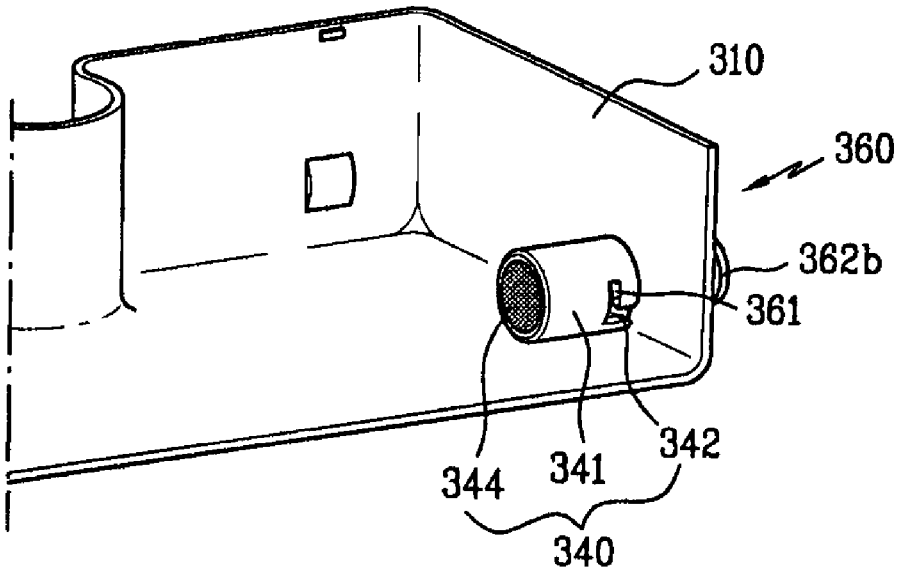

Hereinafter, the attachment and detachment structure between the second filter 340 and the opening and closing member 360 will be described in detail with reference to FIGS. 7A to 7C.

The opening and closing member 360 is mounted to the lower housing 310 of the cartridge 300. The opening and closing member 360 includes a flow channel 362 communicating with the cartridge 300 and a pin 365 for selectively opening and closing the flow channel 362. The flow channel 362 includes an inside flow channel 362*a* and an outside flow channel 362*b*. To the outer surface of the inside flow channel 362*a* is formed a catching protrusion 361. The second filter 340 includes a case 341 formed in a shape corresponding to the inside flow channel 362*a* and a filter ring 344 mounted to one side of the case 341. To the other side of the case 341 is formed a groove 342 corresponding to the catching protrusion 361 of the inside flow channel 362*a*. The groove 342 has a horizontal groove part and a vertical groove part, by which the groove 342 is formed in the shape of an "L." Consequently, as shown in FIG. 7B, the groove 342, specifically the horizontal groove part, of the second filter 340 is fitted on the catching protrusion 361 of the inside flow channel 362*a*, and, as shown in FIG. 7C, the second filter 340 is rotated, with the result that the coupling between the second filter 340 and the opening and closing member 360 is accomplished. The second filter 340 is separated from the opening and closing member 360 in reverse order. Consequently, the separation between the second filter 340 and the opening and closing member 360 will not be given.

Hereinafter, the connection between the cartridge 300 and the pump 400 will be described in detail with reference to FIG. 8.

Figure 8:
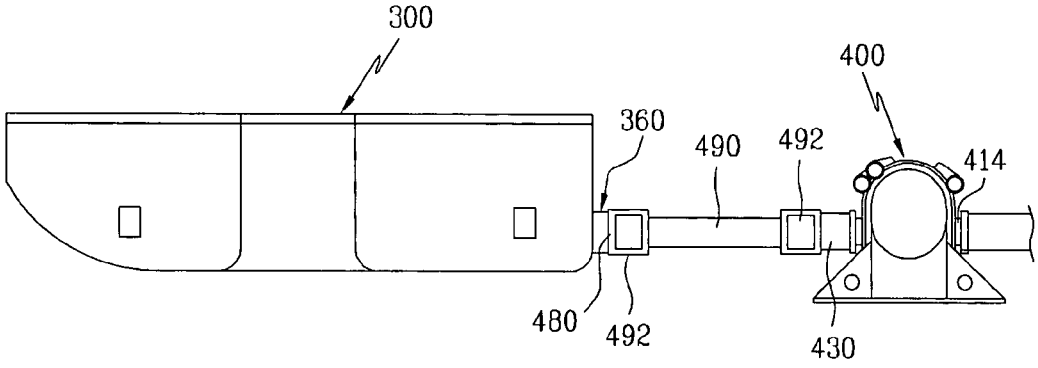
FIG. 8 is a side view illustrating the connection structure between the water supply source of FIG. 4 and a pump.

As shown in FIG. 8, the cartridge 300 and the pump 400 are connected to each other via an intermediate hose 490. One side of the intermediate hose 490 is directly connected to an inlet port 430 of the pump 400, and the other side of the intermediate hose 490 is connected to the cartridge 300 via a connection port 480. Preferably, the inlet port 430 of the pump 400 and the intermediate hose 490 are tightly coupled to each other by a clamp 492, and the connection port 480 and the intermediate hose 490 are also tightly coupled to each other by another clamp 492, whereby the leakage from a gap defined between the inlet port 430 of the pump 400 and the intermediate hose 490 and the leakage from a gap defined between connection port 480 and the intermediate hose 490 are prevented.

Hereinafter, the connection between the cartridge 300 and the connection port 480 will be described in detail with reference to FIGS. 9A to 10.

As previously described, the opening and closing member 360, communicating with the cartridge 300, is mounted to the cartridge 300. The opening and closing member 360 includes the flow channel 362 and the pin 365 for selectively opening and closing the flow channel 362. The flow channel 362 includes the inside flow channel 362*a* and the outside flow channel 362*b*. In addition, an O-ring 369 is mounted to the outer surface of the outside flow channel 362*b* for maintaining airtightness.

Figure 10:
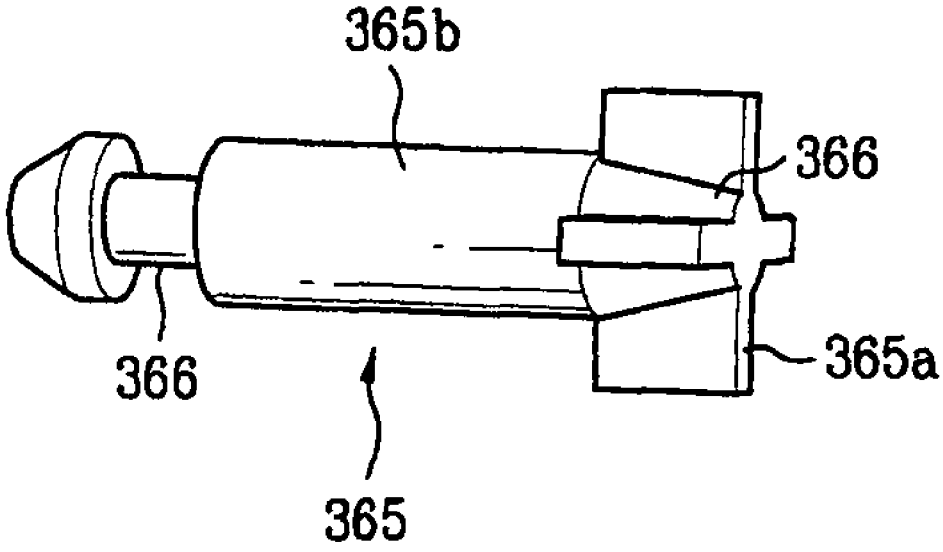
FIG. 10 is a perspective view illustrating a modification of a pin of FIG. 9.

Meanwhile, a concave part 366 is formed at one side of a pin body 365*b* of the pin 365, and a flow part 365*a* is formed at the other side of the pin body 365*b* of the pin 365 see FIG. 10). In the concave part 366 is mounted an opening and closing part 367. The flow part 365*a* is formed approximately in the shape of a cross such that water passes between the cross-shaped blades. Preferably, the opening and closing part 367 is made of rubber.

In the flow channel 362 is mounted a supporting part 363, having a plurality of through-holes 363*a*, for supporting the pin body 365*b* of the pin 365. Between the supporting part 363 and the flow part 365*a* of the pin 365 is mounted spring 364. The connection port 480 includes an outside connection port 482 having an inner diameter greater than the outer diameter of the outside flow channel 362*b* of the opening and closing member 360 and an inside connection port 484 having an outer diameter less than the inner diameter of the outside flow channel 362*b* of the opening and closing member 360.

Figure 9A:
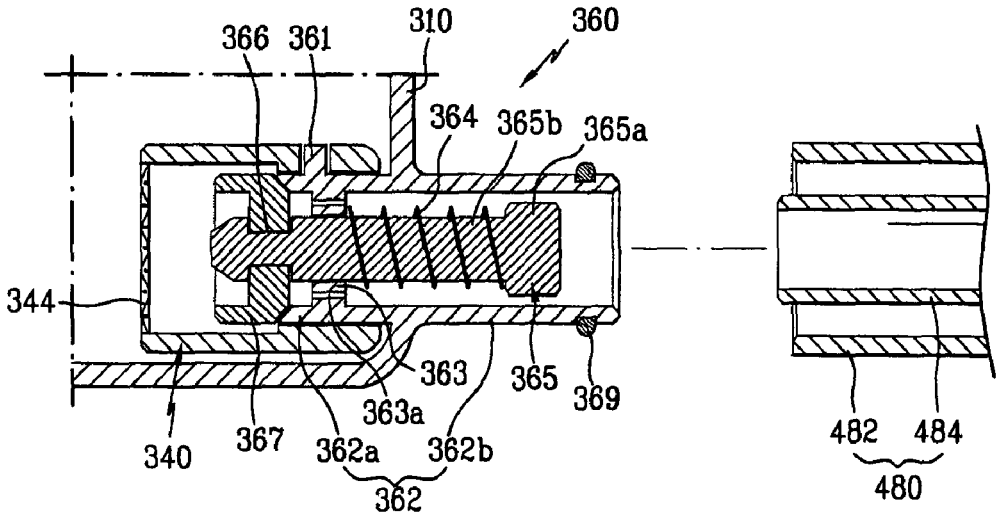
FIGS. 9A and B are sectional views illustrating the attachment and detachment of the water supply source.
Figure 9B:
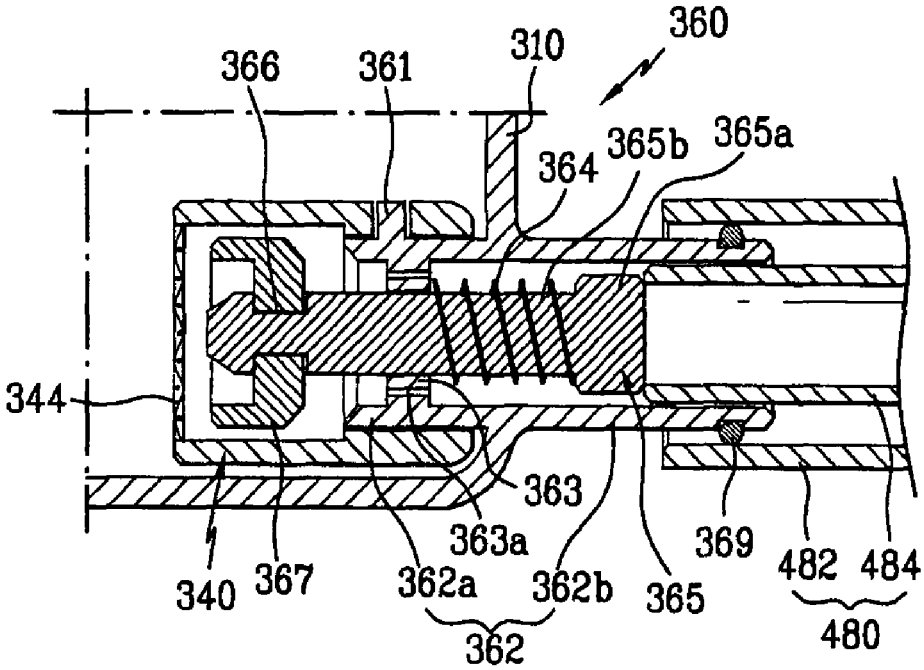

As shown in FIG. 9A, the tip end of the inside flow channel 362*a* is closed by the opening and closing part 367 located at one side of the pin 365, which is elastically biased by the spring 364, in a state in which the cartridge 300 is separated from the connection port 480. Consequently, water in the cartridge 300 is not discharged to the outside through the flow channel. When the cartridge 300 is inserted into the connection port 480, as shown in FIG. 9B, the pin 365 is advanced toward the inside flow channel 362*a* against the elastic force of the spring 364 by the inside connection port 484 of the connection port 480. Consequently, the opening and closing part 368, located at one side of the pin 365, is separated from the tip end of the inside flow channel 362*a*, with the result that water flows therebetween, and therefore, water in the cartridge is discharged to the outside, i.e., to the pump 400, through the flow channel. According to the present invention, the leakage of water is effectively prevented by a double sealing structure using the spring 364 and the O-ring 369.

As shown in FIG. 10, one end of the pin 365, i.e., an interior 366 of the flow part 365*a*, is preferably tapered. In this tapered structure, the area of the flow channel, through which water flows, is increased, as compared to a simple cylindrical structure, whereby more effective flow of water is accomplished.

Figure 11:
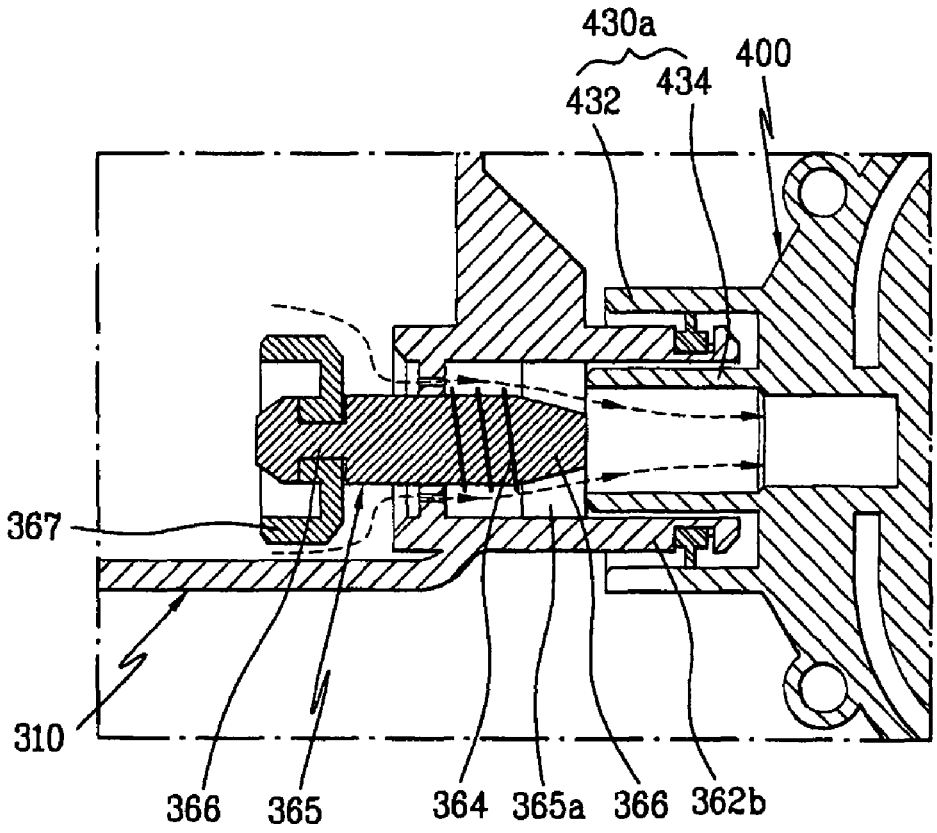
FIG. 11 is a sectional view illustrating another embodiment of the connection structure between the water supply source of FIG. 4 and the pump.

On the other hand, as shown in FIG. 11, the cartridge 300 may be directly connected to the pump without using the intermediate hose 490. In this case, it is necessary to appropriately change the shape of an inlet port 430*a* of the pump 400, such that the inlet port 430*a* includes an outside inlet port 432 and an inside inlet port 434. Specifically, the inlet port 430*a* of the pump 400 is constructed such that the inlet port 430*a* of the pump 400 has a structure similar to that of the connection port 480 of FIG. 9. This structure has an advantage in that the intermediate hose 490, and the clamps 492 for sealing are omitted, and therefore, the material costs are reduced while the manufacturing process is simplified, as compared to the connection structure shown in FIGS. 8 and 9.

In the above-described embodiment, on the other hand, the first filter 330, the second filter 340, and the water softening member 350 are mounted to the detachable cartridge 300. However, the present invention is not limited to the above-specified structure. For example, the present invention may be also applied to a case in which an external faucet is used as the water supply source 300. In this case, it is preferable to mount at least one of the first filter 330, the second filter 340, and the water softening member 350 on the water supply channel, connected to the steam generator 200. Even in this case, it is more preferable to detachably mount the first filter 330, the second filter 340, and the water softening member 350 on the water supply channel. Also, it is preferable that the first filter 330, the second filter 340, and the water softening member 350 are included in a single container, and the container is detachably mounted on the water supply channel.

Figure 12:
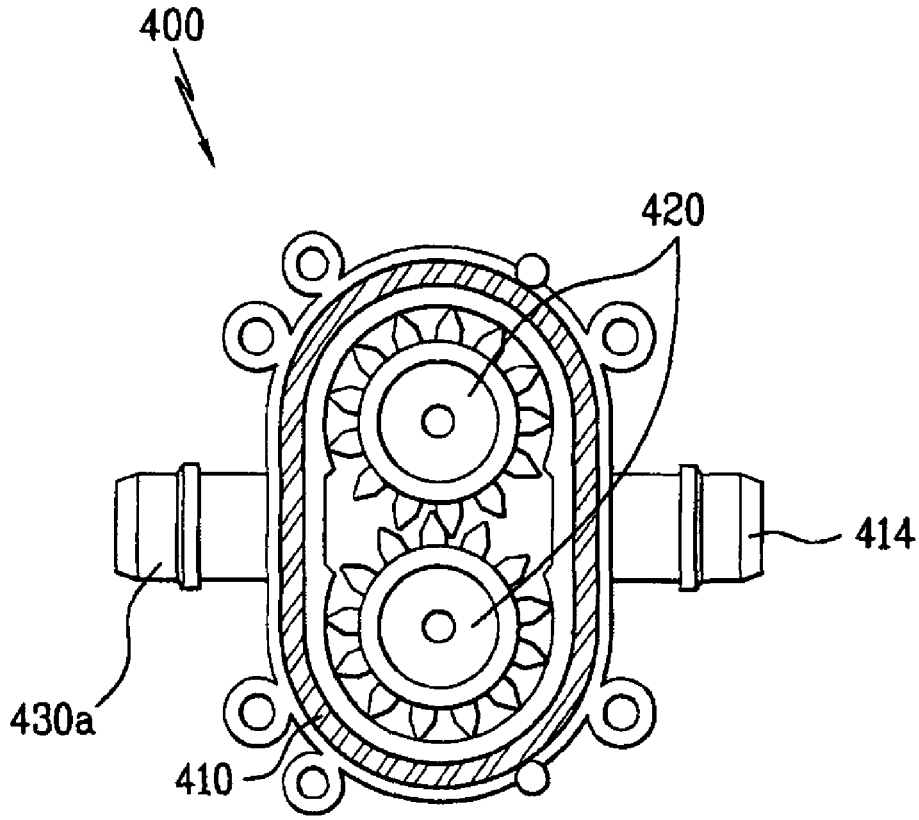
FIG. 12 is a sectional view schematically illustrating an example of the pump of FIG. 4.

Hereinafter, the pump 400 will be described with reference to FIG. 12.

The pump 400 serves to selectively supply water to the steam generator 200. Specifically, the pump 400 is rotated, in the clockwise and counterclockwise directions, to selectively supply water to the steam generator 200 or collect the remaining water from the steam generator 200.

A gear type pump, a pulsating type pump, and a diaphragm type pump may be used as the pump 400. Even in the pulsating type pump and the diaphragm type pump, it is possible to control the flow of a fluid in the clockwise and counterclockwise directions by instantaneously changing the polarities of a circuit. FIG. 12 illustrates a gear type pump 400 as an example of the pump 400. The gear type pump 400 includes a pair of gears 420 disposed in a case 410. The case 410 is provided with an inlet port 430*a* and an outlet port 414. Specifically, water is discharged from the inlet port 430*a* to the outlet port 414 or from the outlet port 414 to the inlet port 430*a* depending upon the rotating direction of the gears 420.

Hereinafter, the nozzle 250 will be described in detail with reference to FIGS. 13 to 17.

Figure 13:
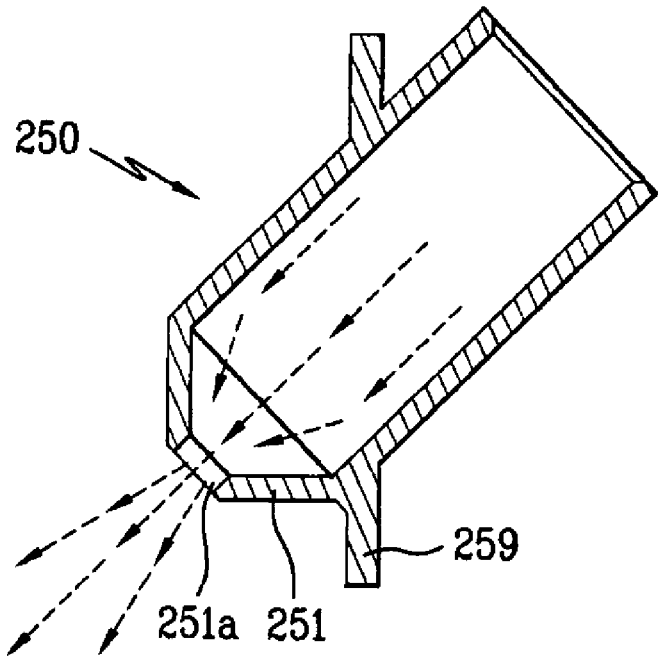
FIG. 13 is a sectional view illustrating an example of a nozzle of FIG. 4.

As shown in FIG. 13, it is possible to construct the nozzle 250 in a general shape. Specifically, it is possible to construct the nozzle 250 in the shape of a pipe having a relatively large diameter and a relatively small diameter such that steam is sprayed into the drum through a spray hole 251*a* formed at the tip end 251 of the nozzle 250. Also, the nozzle 250 is preferably provided with a supporting part 259 for installation of the nozzle 250. When steam is simply sprayed through the spray hole 251*a* formed at the tip end of the nozzle 250, as shown in FIG. 13, the steam is locally sprayed into the drum by the kinetic energy of the steam, whereby the wrinkle removing efficiency may be lowered. Consequently, it is preferable to appropriately change the shape of the nozzle 250.

Figure 14:
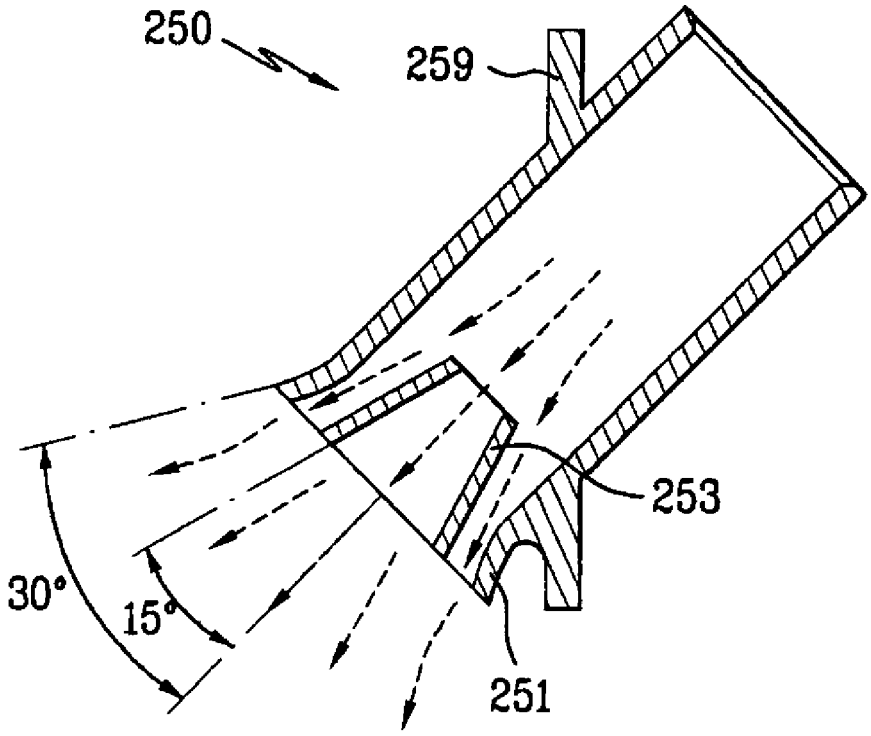
FIGS. 14 and 15 are a sectional view and a perspective view illustrating another example of the nozzle of FIG. 4, respectively.

Hereinafter, another embodiment of the nozzle 250 will be described with reference to FIGS. 14 and 15.

As shown in the drawings, an auxiliary nozzle 253 is mounted in the nozzle 250, which is connected to the steam generator 200 for spraying steam into the drum. In this case, the nozzle 250 may be constructed in a shape having a uniform diameter or in a shape having a relatively large diameter and a relatively small diameter. When the nozzle 250 is constructed in a shape having a relatively large diameter and a relatively small diameter, it is preferable for the tip end 251 of the nozzle 250 to have a slightly increased diameter. The auxiliary nozzle 253 is constructed in a shape having a relatively large diameter and a relatively small diameter, preferably in the shape of a cone. Preferably, the outward inclination angle of the auxiliary nozzle 253 is less than the outward inclination angle of the nozzle 250. For example, the nozzle 250 is inclined outward by 30 degrees, whereas the auxiliary nozzle 253 is inclined outward by 15 degrees.

With the above-stated construction, it is possible to increase the diffusion angle of steam, such that clothes can be uniformly wetted by the steam, thereby improving the wrinkle removing efficiency.

Figure 15:
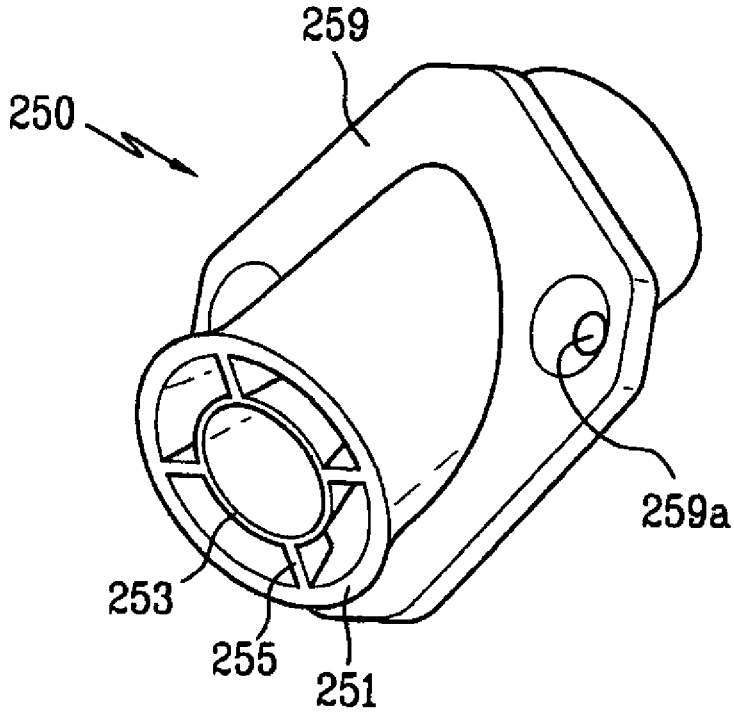

In FIG. 15, unexplained reference numeral 259*a* indicates coupling holes formed in the support part.

Figure 16:
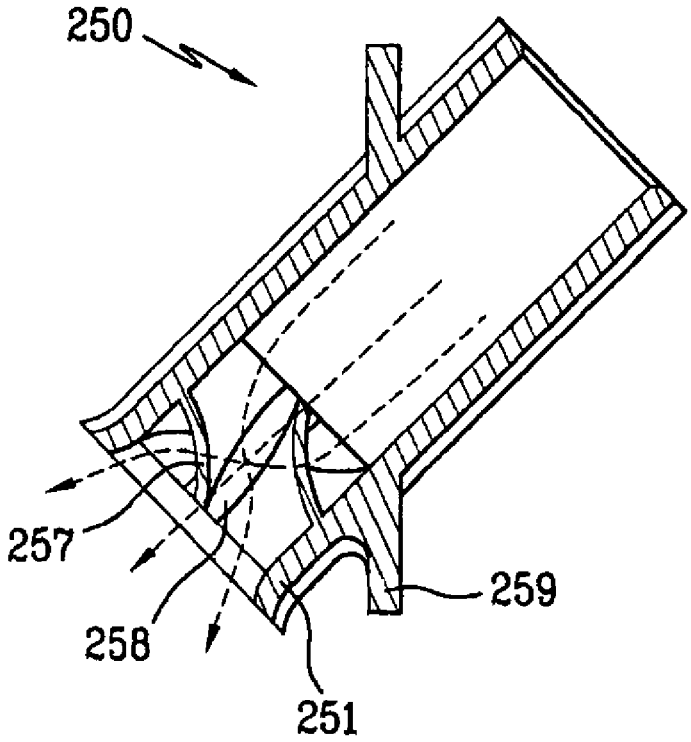
FIGS. 16 and 17 are a sectional view and a perspective view illustrating a further example of the nozzle of FIG. 4, respectively.
Figure 17:
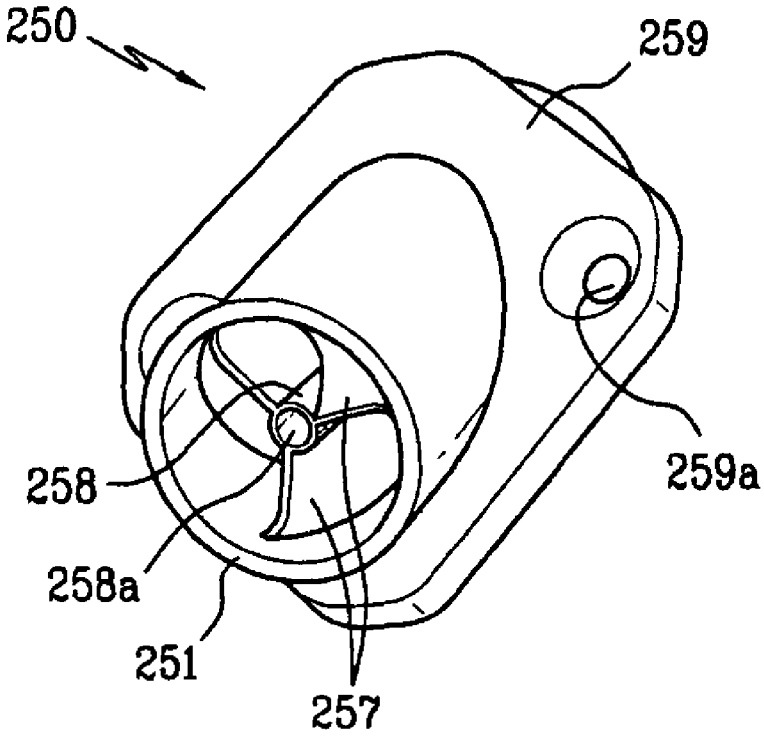

Hereinafter, a further example of the nozzle 250 will be described with reference to FIGS. 16 and 17.

Preferably, a whirlpool generating member, for generating a whirlpool, is mounted in the nozzle 250. In this case, the nozzle 250 may be constructed in a shape having a uniform diameter or in a shape having a relatively large diameter and a relatively small diameter. When the nozzle 250 is constructed in a shape having a relatively large diameter and a relatively small diameter, it is preferable for the tip end 251 of the nozzle 250 to have a slightly increased diameter.

Preferably, the whirlpool generating member includes blades 257. Each blade 257 extends inward from the inner wall of the nozzle 250. Preferably, each blade 257 is formed in the shape of a curve. The blades 257 may be directly connected to each other at the center of the nozzle 250. Preferably, however, a central member 258 is disposed in the nozzle 250 such that each blade is connected between the inner wall of the nozzle 250 and the central member 258. More preferably, a flow channel 258*a* is formed in the central member 258. With this construction, it is possible to improve moldability and mass productivity.

With the above-stated construction, a whirlpool is generated, during the flow of steam, to increase the kinetic energy and the diffusion angle, such that clothes can be uniformly wetted by the steam, whereby the wrinkle removing efficiency is improved.

Figure 18:
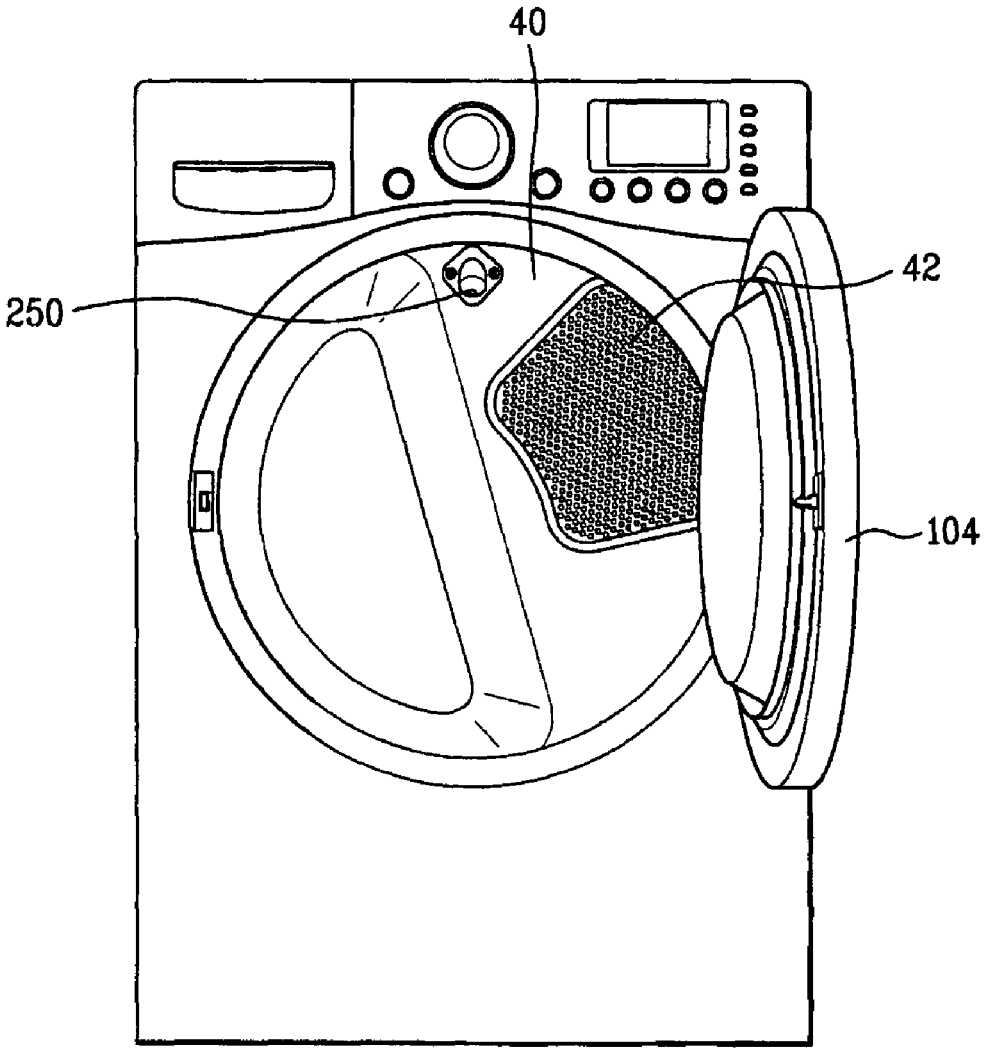
FIG. 18 is a front view illustrating an installation example of the nozzle of FIG. 4.

Meanwhile, as shown in FIG. 18, the nozzle 250 is preferably mounted adjacent to the opening 42, through which hot air is supplied into the drum, such that steam can be sprayed to the front of the drum from the rear of the drum. This is because air is introduced from the opening 42 formed at the rear supporter 40, and is then discharged to the lint duct (not shown, see FIG. 1) below the door 104. As a result, the air flow channel serves as the lint duct approximately at the opening 42. Consequently, when the nozzle 250 is mounted adjacent to the opening 42, the sprayed steam flows along the air flow channel, whereby the clothes are uniformly wetted by the steam.

Meanwhile, the nozzle 250, described in this embodiment, may also be applied to a laundry machine having a water supply source different from the detachable water supply source 300. For example, the nozzle 250 may be applied to a case in which an external faucet is used as the water supply source 300.

Hereinafter, the safety valve 500 will be described in detail with reference to FIGS. 13 and 19.

During the normal operation of the steam generator 200, steam is sprayed into the drum through the steam hose 230 and the nozzle 250. However, when micro fiber articles of lint or foreign matter, generated during the clothes drying process, are attached to the spray hole 251*a* of the nozzle 250 and accumulate in the spray hole 251*a*, and therefore, the spray hole 251*a* is closed, the steam is not smoothly supplied into the drum, but the pressure of the steam is applied to the steam generator 200 in the reverse direction. As a result, the pressure in the steam generator 200 is increased, whereby the steam generator 200 may break. Especially, the water tank, which is generally used in the tub heating type steam generator, is not manufactured according to an internal pressure design for a high-pressure container, with the result that a possibility of breakage is further increased. Consequently, it is preferable to provide an appropriate safety device.

When the steam flow channel, through which the steam generated by the steam generator flows, is clogged, the safety valve 400 functions to discharge the steam to the outside. Consequently, the safety valve 500 is preferably mounted in the steam flow channel, for example, the steam hose 230. More preferably, the safety valve 500 is mounted near the tip end of the steam hose 230, for example, adjacent to the nozzle 250.

The safety valve 500 includes a case 510 having one end communicating with the steam hose 230 and the other end communicating with the outside, and an opening and closing part 530 mounted in the case 510 for selectively opening and closing the case 510 and the steam hose 230. Specifically, the opening and closing part 530 is mounted in a steam flow channel communication part 513 of the case 510. The opening and closing part 530 is supported by a spring 520. Of course, one end of the spring 520 is connected to the opening and closing part 530, and the other end of the spring 520 is connected to a fixed part 540, which is fixed to the case 510 in a predetermined fashion.

Figure 19A:
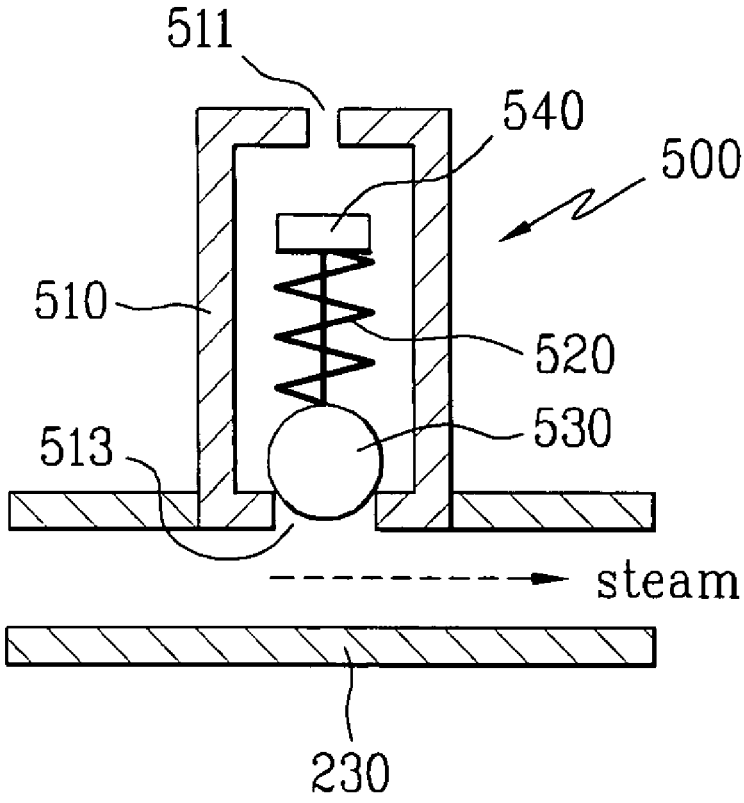
FIGS. 19A and 19B are sectional views schematically illustrating an example of a safety valve of FIG. 4.
Figure 19B:
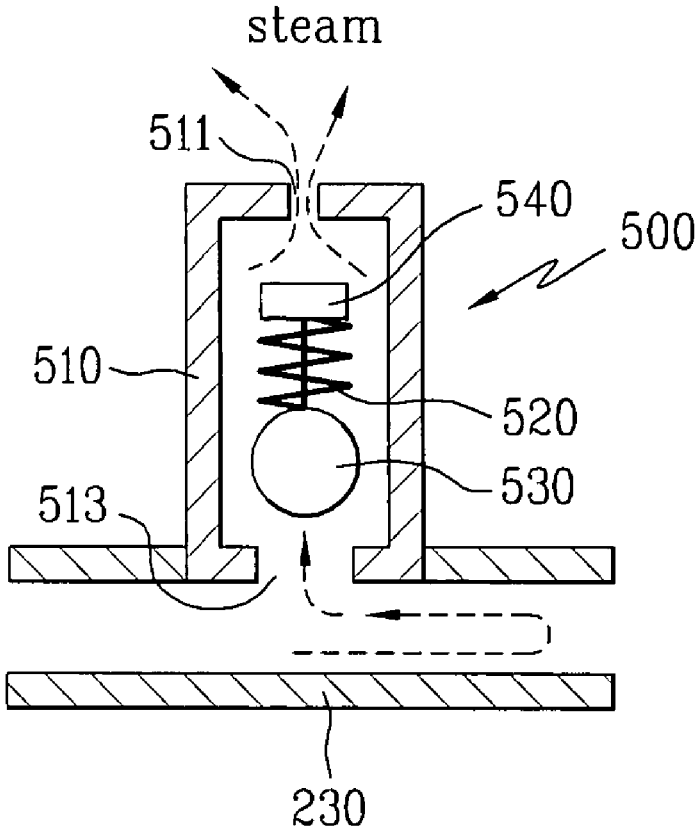

When the steam hose 230 is not clogged, as shown in FIG. 19A, and therefore, the pressure in the steam hose 230 is less than a predetermined pressure level, steam does not overcome the elastic force of the spring 520. Consequently, the opening and closing part 530 closes the steam flow channel communication part 513, with the result that the steam is not discharged to the outside. However, when the steam hose 230 is clogged, as shown in FIG. 19B, and therefore, the pressure in the steam hose 230 exceeds the predetermined pressure level, for example, 1 kgf/cm$^2$, steam overcomes the elastic force of the spring 520. Consequently, the opening and closing part 530, closing the steam flow channel communication part 513, is moved, with the result that the steam is discharged to the outside through the steam flow channel communication part 513 and an external communication part 511.

Figure 20:
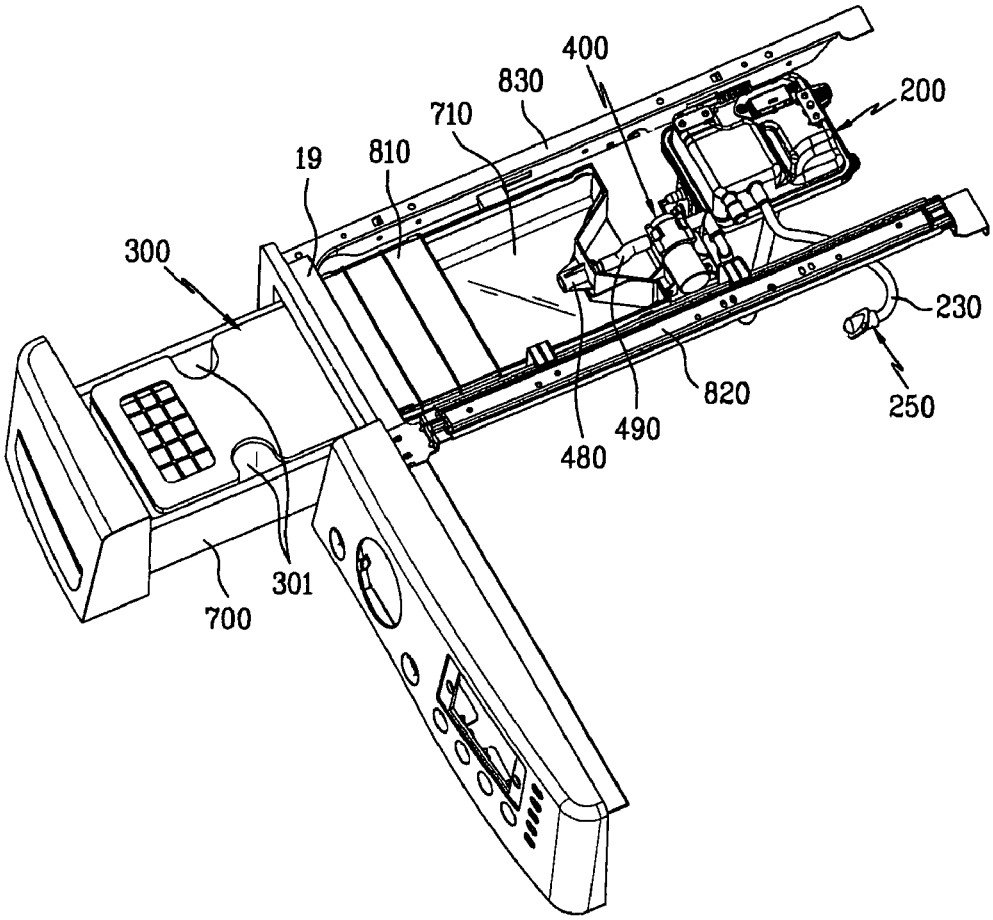
FIG. 20 is a perspective view illustrating an installation example of the components of FIG. 4.

Hereinafter, an installation example of the components of a steam line, principally including the steam generator according to the present invention, will be described with reference to FIG. 20.

At a predetermined position, in the laundry machine, is mounted a drawer-type container (hereinafter, referred to as a "drawer") 700 that can be inserted and withdrawn. Preferably, the cartridge 300 is mounted in the drawer 700. Specifically, the cartridge 300 is not directly connected to the connection port 480. Instead, the cartridge 300 is mounted in the drawer 700, and the drawer 700 is inserted and withdrawn such that the cartridge 300 is indirectly coupled to and separated from the connection port 480.

Preferably, the drawer 700 is located at the front of the laundry machine, for example, at the control panel 19. More specifically, a supporter 820 is mounted at the rear of the control panel 19. The supporter 820 is arranged approximately in parallel with a top frame 830. To the supporter 820 and the top frame 830 is preferably mounted a drawer guide 710 for guiding and supporting the drawer 700. More preferably, a top guide 810 is mounted at a portion of the top of the drawer guide 710.

The top and one side (the front of the laundry machine) of the drawer guide 710 are open. The drawer 700 is inserted and withdrawn through the side opening of the drawer guide 710. The connection port 480 is mounted to the top of the drawer guide 710 at the other side of the drawer guide 710.

As described above, it is preferable to install the drawer 700 at the front of the laundry machine in consideration of convenience in use. FIG. 20 illustrates the control panel 19 installed at the front cover of the laundry machine. Consequently, the drawer 700 is inserted into and withdrawn from the control panel 19. However, the present invention is not limited to the above-specified structure. For example, when the control panel is mounted at the top cover of the laundry machine, as shown in FIG. 1, the drawer 700 may be directly mounted at the front cover of the laundry machine.

When the cartridge 300 is mounted in the drawer 700, on the other hand, it is preferable that at least opposite sides of the cartridge 300 correspond in shape to those of the drawer 700, and therefore, the cartridge 300 is tightly coupled to the drawer 700. At the opposite sides of the cartridge 300 are preferably formed concave parts 301 for allowing a user to mount and separate the cartridge 300 in and from the drawer 700.

Hereinafter, a method of supplying water to the cartridge 300 will be described in detail with reference to FIG. 20.

When a user withdraws the drawer 700, the cartridge 300 is also withdrawn. In this state, the user separates the cartridge 300 from the drawer 700. Subsequently, the user supplies water into the separated cartridge 300 through the water supply port, for example, the first filter 330, such that the cartridge 300 is filled with the water. After that, the user puts the cartridge 300, which is filled with the water, in the drawer 700, and then pushes the drawer 700 inward. As a result, the cartridge 300 is automatically coupled to the connection port 480, and therefore, the water in the cartridge flows toward the pump 400.

After the use of the laundry machine is completed, the user may separate the cartridge 300 from the drawer 700 in the reverse sequence. According to the present invention, the cartridge 300 includes the upper housing 320 and the lower housing 310. Consequently, it is easy and convenient to clean the separated cartridge 300.

Figure 21:
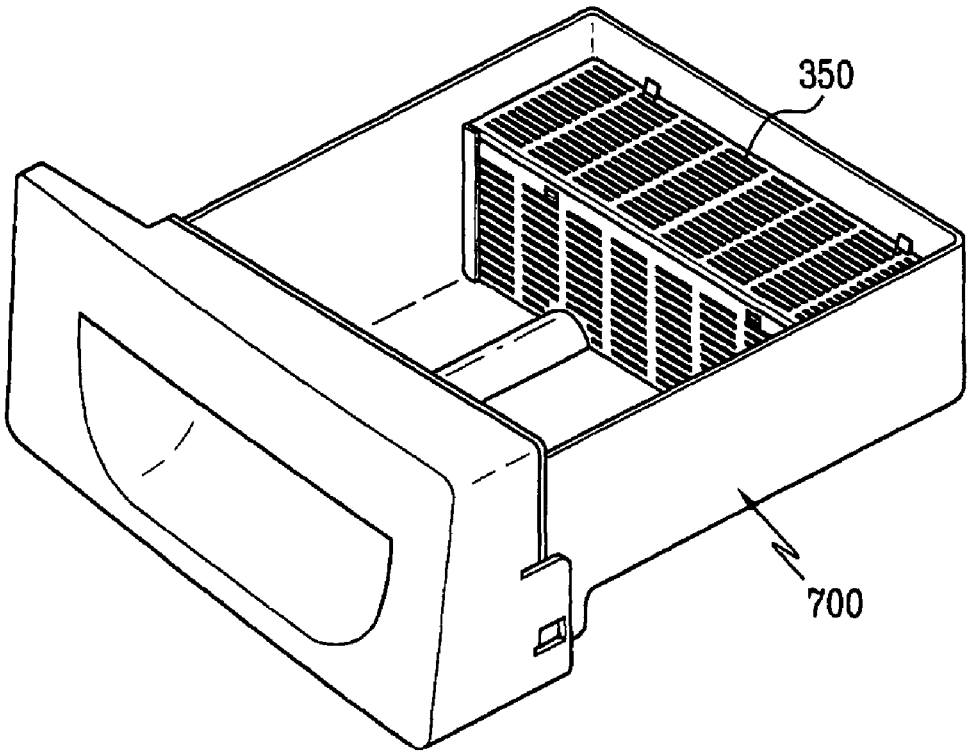
FIG. 21 is a perspective view illustrating another example of the water supply source of FIG. 4.

As shown in FIG. 21, on the other hand, the drawer 700 may be used as a directly detachable water supply source. When the drawer 700 is used as the directly detachable water supply source, however, water may overflow due to carelessness of a user during the supply of water to the drawer 700. This problem may be solved to some extent by using the cartridge 300 as the detachable water supply source. When the drawer 700 is used as the directly detachable water supply source, it is possible to simplify the structure of the drawer 700. FIG. 21 illustrates only the water softening member 350 mounted in the drawer 700 for convenience of description. However, the present invention is not limited to this structure. For example, the first filter 330 and the second filter 340 may be also mounted in the drawer 700.

Hereinafter, a control method of the laundry machine according to the present invention will be described with reference to FIGS. 22 and 23.

The laundry machine may be generally operated in two operation modes. One operation mode is to perform the original function of the laundry machine, i.e., the clothes drying operation. The other operation mode is to perform an operation for removing wrinkles from clothes (hereinafter, referred to as a "refreshing operation" for convenience. During the refreshing operation, it is possible to sterilize the clothes, remove smells from the clothes, prevent the occurrence of static electricity in the clothes, and fluff the clothes in addition to the removal of wrinkles from the clothes. A control method for the drying operation generally includes a hot air supply step and a cooling step. These steps are also used in the conventional laundry machine, and therefore, a detailed description thereof will not be given. A control method for the refreshing operation especially includes a steam supply step, which will be described below in detail.

The control method of the laundry machine for the refreshing operation includes a steam supply step (SS5) of supplying steam to the drum and a hot air supply step (SS7) for supplying hot air to the drum. Preferably, a drum heating step (SS3) is carried out before the steam supply step (SS5). Also, the control method for the refreshing operation further includes a water supply step (SS1) of supplying water to the steam generator to generate steam necessary at the steam supply step (SS5).

Preferably, the water supply step (SS1) is carried out before the drum heating step (SS3). Also preferably, the control method according to the present invention further includes a cooling step (SS9) of cooling the drum, which is carried out after the hot air supply step (SS7). Preferably, the control method according to the present invention further includes a water collection step of discharging water remaining in the steam generator, i.e., the remaining water in the steam generator, to the outside, which is carried out after the steam supply step (SS5). (The water collection step will be described hereinafter in detail.) The drum may be heated using an additional heater mounted in the drum; however, it is preferable to simply use the hot air heater.

Now, the respective control steps will be described in detail.

The drum heating step (SS3) is a step of heating the drum to a predetermined temperature such that the removal of wrinkles from the clothes can be more effectively performed at the next step, i.e., the steam supply step (SS5). The drum heating step (SS3) is carried out for a predetermined period of time (T_pre-T_pump). At this time, the drum is rotated, preferably tumbled. More preferably, the drum is intermittently tumbled. Tumbling is rotating the drum at a speed of approximately 50 rpm or less such that the clothes are not attached to the inner wall of the drum. Tumbling is well known in the art to which the present invention pertains, and therefore, a detailed description thereof will not be given.

Preferably, the drum heating step (SS3) is initiated at a point of time when the water level in the steam generator reaches a high water level after water is supplied to the steam generator for a predetermined period of time (T_pump). Also preferably, the steam heater is operated at a point of time when the drum heating step (SS3) is initiated. This is because steam is generated a predetermined period of time after the steam heater is operated.

Also preferably, the termination of the drum heating step (SS3) approximately coincides with a point of time when the steam is generated. Actually, the drum heating step (SS3) is preferably terminated before the steam is supplied into the drum. This is because, when the drum is continuously heated at the point of time when the steam is generated, i.e., at the steam supply step (SS5), the interior temperature of the drum is excessively increased, with the result that the steam, supplied into the drum, may be evaporated into gas.

The steam supply step (SS5) is a step of supplying steam to the drum such that the removal of wrinkles from the clothes is principally performed. The steam supply step (SS5) is carried out for a predetermined period of time (T_steam). At this time, the drum is rotated, preferably tumbled. More preferably, the drum is intermittently tumbled. The period of time (T_steam), for which the steam supply step (SS5) is carried out, is previously decided and established through experiments based on a factor, such as the amount of an object to be dried. At the steam supply step (SS5), the water level in the steam generator is lowered. Consequently, water is preferably supplied to the steam generator when a low water level is detected. In this case, water may be continuously supplied to the steam generator until the high water level is detected. Preferably, however, water is supplied to the steam generator for a predetermined period of time before the water level in the steam generator reaches the high water level, for example, approximately 3 seconds, so as to increase the heating efficiency. If the water is supplied to the steam generator until the water level in the steam generator reaches the high water level, it is necessary to heat a large amount of water. Consequently, the supply of steam is interrupted for a predetermined period of time, and, after the water is boiled, the supply of steam is resumed. However, when the water is supplied to the steam generator for the predetermined period of time, for example, 3 seconds, steam is generated in approximately 1 second. Consequently, it is possible to nearly continuously supply steam into the drum.

Also, it is preferable that tumbling at the steam supply step (SS5) is repeated intermittently and periodically, for example, approximately 3 seconds per minute. At the steam supply step (SS5), the drum may be continuously tumbled. In this case, however, the steam, supplied into the drum, may be immediately discharged to the outside without the stay of the steam in the drum. This is because the blower unit and the drum are simultaneously driven by a single motor, and therefore, when the drum is rotated, the blower unit is also operated to discharge the steam out of the drum. Consequently, it is preferable to rotate intermittently the drum, such that the rotation time of the drum is less than the stop time of the drum, at the steam supply step (SS5).

Also, the researches carried out by the inventor of the present invention revealed that the position of clothes in the drum was continuously changed during the rotation of the drum, whereas, the clothes were placed approximately at the lower front of the drum, i.e., near the door, when the drum was stopped. However, it is difficult to change the spray direction of the nozzle, and therefore, the nozzle is fixed such that the nozzle is directed to the lower front of the drum. For this reason, it is preferable that the clothes be placed in the spray direction of the nozzle, i.e., at the lower front of the drum. Consequently, it is preferable to control the drum to be rotated for a short period of time, such that the clothes can be placed in the spray direction of the nozzle, and therefore, a large amount of steam can be absorbed into the clothes, at the steam supply step (SS5).

The hot air supply step (SS7) is a step of supplying hot air, generated by the hot air heater, to the drum such that clothes, which can be slightly wetted by the steam, are dried again. The hot air supply step (SS7) is carried out for a predetermined period of time (T_dry). At this time, the drum is not tumbled. The period of time (T_dry), for which the hot air supply step (SS7) is carried out, is also previously decided and established through experiments based on a factor, such as the amount of an object to be dried. It is preferable to discharge the water remaining in the steam generator to the cartridge after the hot air supply step (SS7) is completed. At this time, the temperature of the remaining water in the steam generator is high. Consequently, the remaining water in the steam generator is not immediately discharged to the cartridge, but the discharge of the remaining water in the steam generator is delayed for a predetermined period of time (T_delay). When the temperature in the steam generator is less than a predetermined temperature (Temp_crit), the remaining water in the steam generator is discharged to the cartridge. (The details will be described below.)

The cooling step (SS9) is a step of cooling an object to be dried, the temperature of which has been increased at the hot air supply step (SS7). The cooling step (SS9) is carried out for a predetermined period of time (T_cooling). At this time, the drum is not tumbled. The period of time (T_cooling), for which the cooling step (SS9) is carried out, is also previously decided and established through experiments based on a factor, such as the amount of an object to be dried. Although cool air may be supplied to the drum at the cooling step (SS9), the temperature of the object is not relatively high. Consequently, the object may be left as it is for a predetermined period of time, which is simple but preferred.

Hereinafter, a method of controlling the pump will be described with reference to FIGS. 22 and 23.

The pump control method according to the present invention includes a water supply step (S100 and S200) of supplying water to the steam generator, which generates steam to be supplied to the drum, and a water collection step (S300) of collecting the water remaining in the steam generator. Of course, the water supply step (S100 and S200) preferably includes an initial water supply step (S100) and a water level maintenance step (S200) of maintaining the water level in the steam generator. On the other hand, the water collection step (S300) is preferably carried out by the pump. More preferably, the water is collected to the detachable water supply source, which is connected to the steam generator.

Now, the respective steps will be described in detail.

As described above, the water supply step (S100 and S200) preferably includes the initial water supply step (S100) and the water level maintenance step (S200) of maintaining the water level in the steam generator. The pump is rotated in the clockwise direction to supply water to the steam generator (S1). When the water level in the steam generator reaches a high water level (S3), the pump is stopped, and the steam heater is operated (S5).

As the steam heater is operated, water is heated to generate steam. With the discharge of the generated steam, the water in the steam generator is reduced. Consequently, the water level in the steam generator is detected, and, when the water level in the steam generator reaches a low water level, the pump is rotated in the clockwise direction to supply water to the steam generator (S9 and S11). At this time, as previously described, the water may be continuously supplied to the steam generator until the high water level is detected. Preferably, however, water is supplied to the steam generator for a predetermined period of time, for example, approximately 3 seconds, so as to increase the heating efficiency.

When a predetermined period of steam supply time (T_steam) has elapsed (S7), on the other hand, the steam heater is stopped (S13), and a predetermined period of time (T_delay) is delayed (S15). The reason why the predetermined period of time (T_delay) is delayed is to maximally lower the temperature of the remaining water in the steam generator. Subsequently, when the temperature in the steam generator is lower than a safety temperature (Temp_crit) (S17), the pump is rotated in the counterclockwise direction for a predetermined period of time, for example, approximately 30 seconds, to collect the remaining water from the steam generator (S25). However, when the temperature in the steam generator is higher than the safety temperature (Temp_crit), the remaining water is not directly collected from the steam generator but safety measures are taken. For example, it is determined whether the water level in the steam generator is lower than the high water level (S19). When it is determined that the water level in the steam generator is lower than the high water level, the pump is rotated in the clockwise direction for a predetermined period of time, for example, approximately 5 seconds, to resupply water to the steam generator (S21). When it is determined that the water level in the steam generator is not lower than the high water level, on the other hand, the temperature in the steam generator is compared with the safety temperature (Temp_crit) (S23). When the temperature in the steam generator is lower than the safety temperature (Temp_crit) (S23), the pump is rotated in the counterclockwise direction for a predetermined period of time, for example, approximately 30 seconds, to collect the remaining water from the steam generator (S25). When the temperature in the steam generator is higher than the safety temperature (Temp_crit), on the other hand, the procedure is ended without the rotation of the pump in the counterclockwise direction to collect the remaining water from the steam generator (S27). Of course, the temperature in the steam generator may be compared with the safety temperature after a predetermined period of time is delayed, and, when the above-mentioned requirement is satisfied, the remaining water may be collected from the steam generator. Here, the safety temperature (Temp_crit) means the maximum temperature at which the reliability of the pump is maintained. For example, the safety temperature is approximately 60 degrees.

Figure 22:
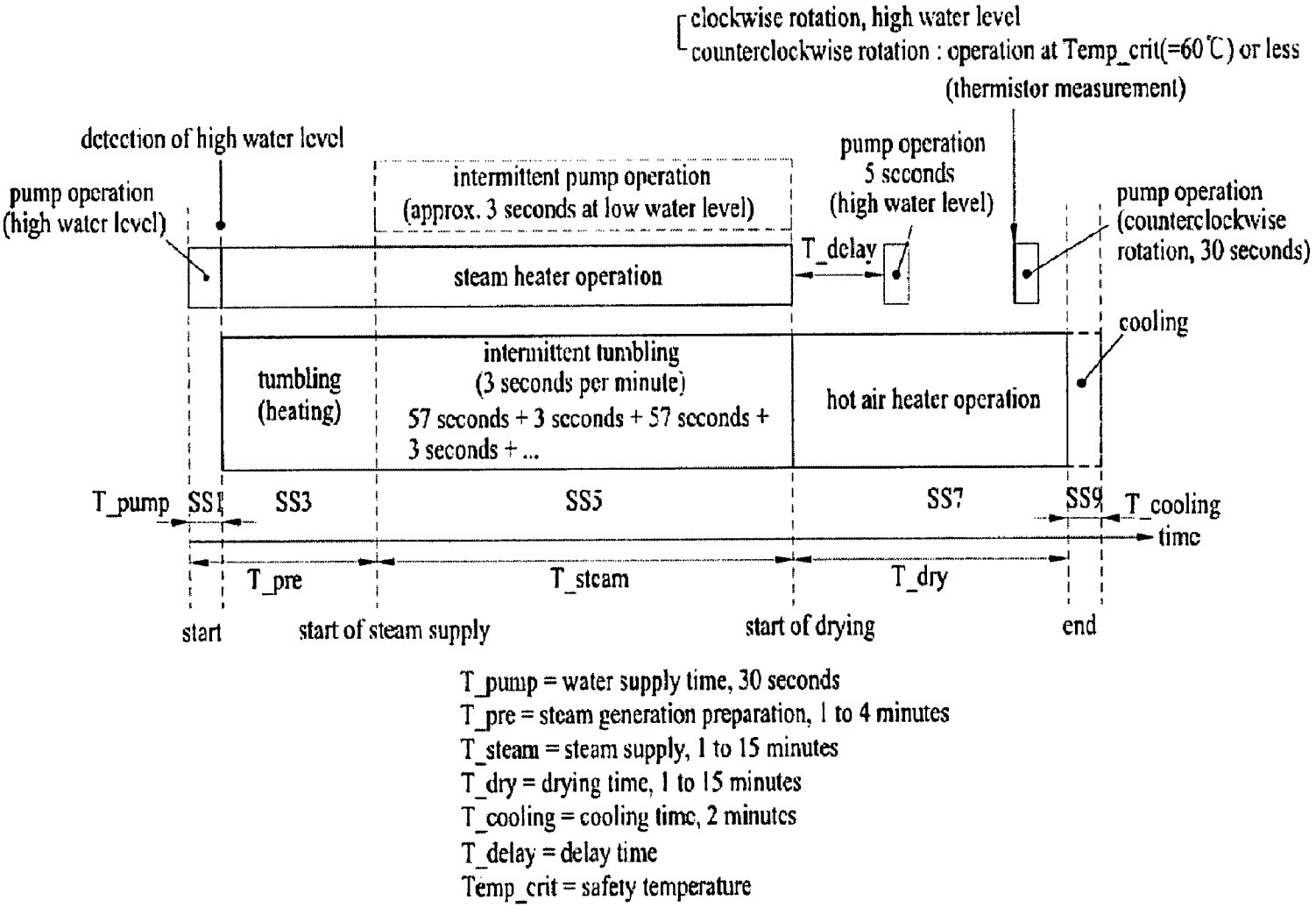
FIG. 22 is a view illustrating an embodiment of a control method of a laundry machine according to the present invention.
Figure 23:
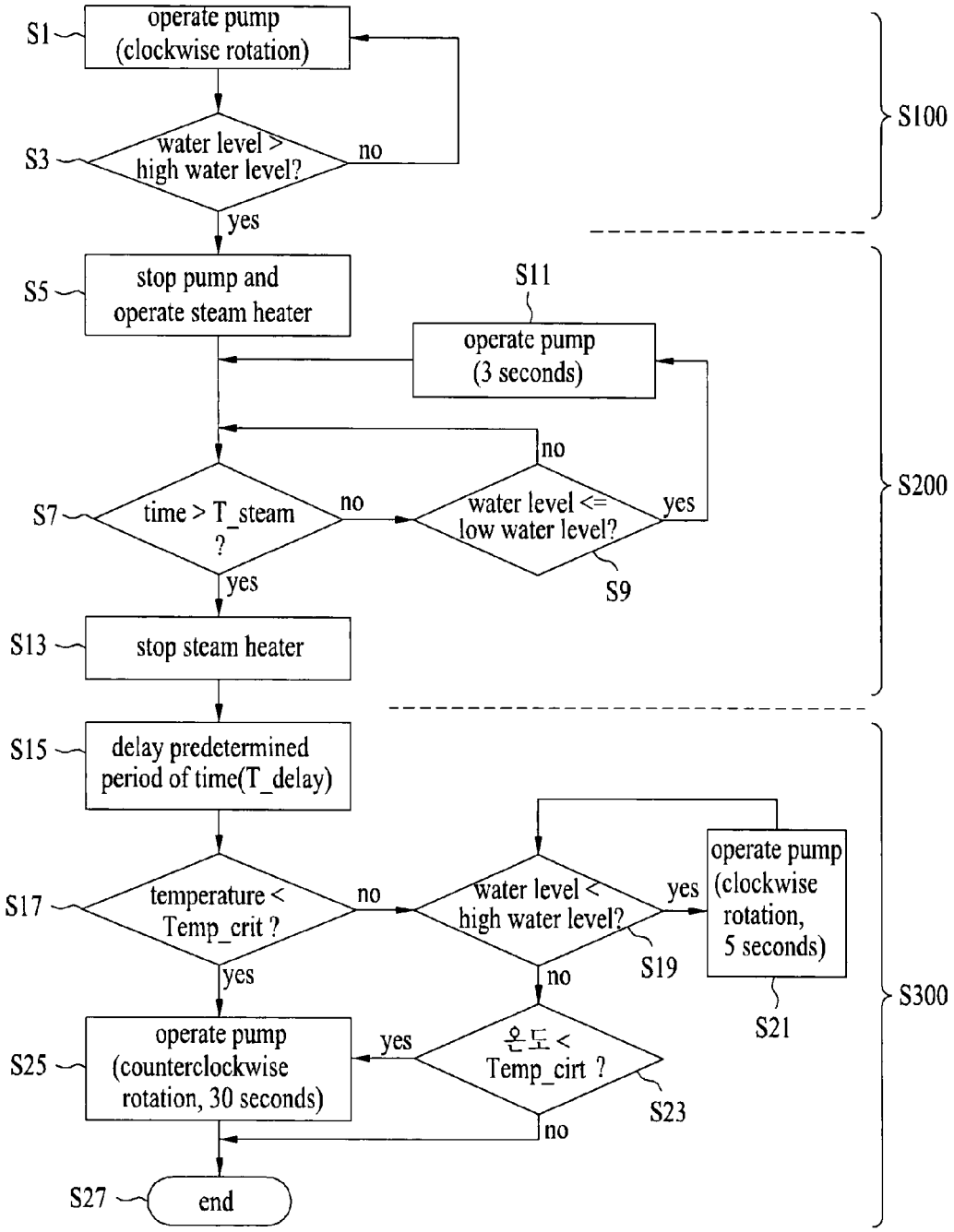
FIG. 23 is a flow chart illustrating a method of controlling a pump of FIG. 22.

The water supply time (T_pump), the steam generation preparing time (T_pre), the steam supply time (T_steam), the drying time (T_dry), the cooling time (T_cooling), the delay time (T_delay), the tumbling time, and the pump operating time, shown in FIGS. 22 and 23, are illustrative examples, and the above-specified times may be appropriately changed depending upon the capacity of the laundry machine or the amount of an object to be dried.

Figure 24:
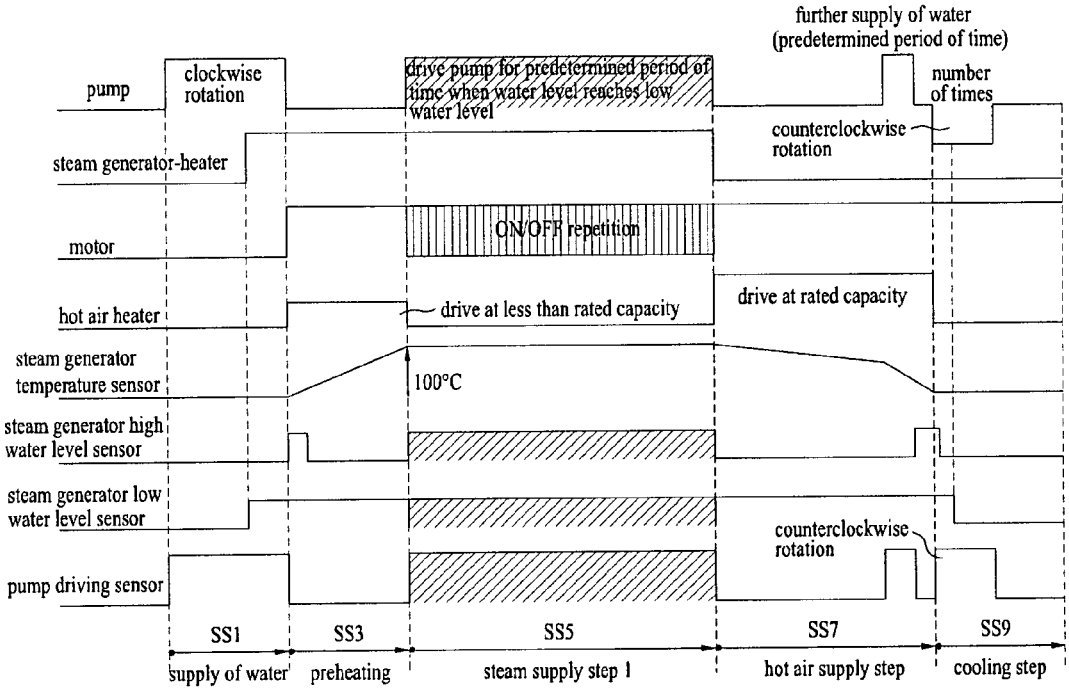
FIG. 24 is a view illustrating another embodiment of a control method of a laundry machine according to the present invention.

Hereinafter, another embodiment of a control method of a laundry machine according to the present invention will be described with reference to FIG. 24.

This embodiment is identical in its basic principle to the previous embodiment; however, this embodiment is provided to more effectively carry out the generation of steam.

Steam is supplied into the drum at the steam supply step (SS5). However, even when the steam generator is operated, time necessary to boil water is needed. For this reason, the steam is not immediately generated. Consequently, it is preferable to operate the steam generator before the steam is supplied into the drum. For safety, however, it is preferable to operate the heater of the steam generator when the water level in the steam generator reaches the low water level.

On the other hand, a point of time when the drum heating step (SS3) is initiated, i.e., the operation of the hot air heater is initiated, may be after the operation of the steam generator. However, it is preferable to operate the hot air heater, when the water level in the steam generator reaches the high water level or when the heater of the steam generator is turned on, in consideration of the thermal capacity of the water in the steam generator.

At this time, the hot air heater may be operated at a rated capacity. However, it is preferable to operate the hot air heater at a capacity less than the rated capacity. For example, when the rated capacity of the hot air heater is 5400 W, it is preferable to operate the hot air heater at approximately half of the rated capacity, i.e., 2700 W. This is because the heater of the steam generator is also operated at the drum heating step (SS3), and therefore, when the hot air heater is operated at the rated capacity, it is required to increase the total power to be supplied to the laundry machine.

Meanwhile, the water supply step (SS1), i.e., the supply of water to the steam generator, is generally terminated when the water level in the steam generator reaches the high water level. However, it is preferable to forcibly perform the next step a predetermined time, for example 90 seconds, after the supply of water is initiated, i.e., the operation of the pump is initiated, irrespective of whether the water level in the steam generator reaches the high water level or not. This is because, when the high water level is not detected due to the abnormality of the steam generator, the water in the steam generator overflows into the drum. Consequently, it is preferable to perform the next step after the elapse of the predetermined time.

Also, the drum heating step (SS3) is generally terminated when steam is generated by the steam generator. However, it is preferable to forcibly perform the next step after a predetermined time, for example 5 minutes. This is because, although a probability of the hot air heater being abnormal is generally low, it is preferable to perform the next step after the predetermined time for the sake of safety. Meanwhile, it is very difficult to confirm whether steam is generated by the steam generator. Consequently, it is preferable that the drum heating step (SS3) be terminated before steam is supplied into the drum.

The results of experiments carried out by the inventor of the present invention revealed that the refreshing operation according to the present invention had the effect of removing and preventing wrinkles on clothes although there was a difference depending upon the kinds of clothes, for example, the kinds of materials for the clothes, and the hygroscopic degree of the clothes. An example of an object to be dried may be laundry spin-dried by a laundry washing machine. However, the object is not limited to the laundry. For example, the present invention is particularly useful when wrinkles on clothes worn approximately one day, i.e., the clothes which are already dried and a little wrinkled, are removed by the laundry machine according to the present invention. In other words, the laundry machine according to the present invention may be used as a kind of wrinkle removing apparatus.

Figure 25:
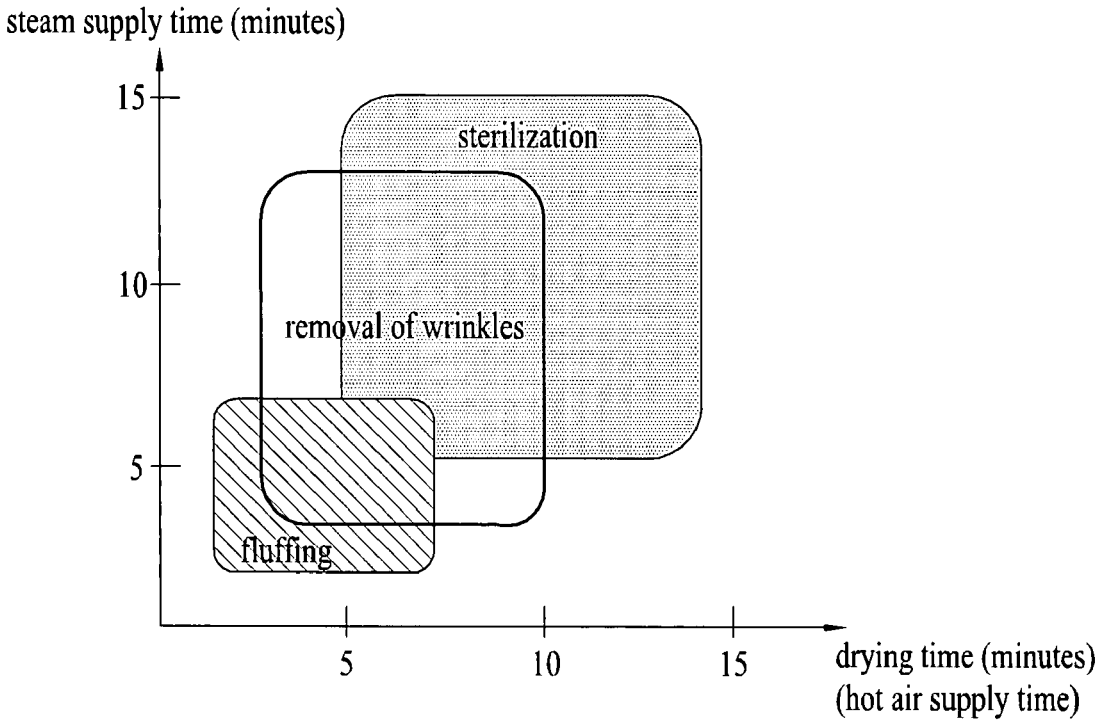
FIG. 25 is a view illustrating a further embodiment of a control method of a laundry machine according to the present invention.

Hereinafter, a further embodiment of a control method of a laundry machine according to the present invention will be described with reference to FIG. 25.

As previously described, the refreshing operation according to the present invention has the effect of removing wrinkles from the clothes. In addition, the research carried out by the inventor of the present invention revealed that the refreshing operation had the effect of sterilizing and fluffing the clothes to some extent. The operation of the laundry machine for performing this function basically includes the steam supply step and the hot air supply step (drying step). However, it is preferable to appropriately change the steam supply time and the hot air supply time according to the purpose.

For example, the steam supply time and the hot air supply time are preferably longer when sterilizing the clothes than when removing the wrinkles from the clothes. On the other hand, the steam supply time and the hot air supply time are preferably shorter when fluffing the clothes than when removing the wrinkles from the clothes. The optimum time may be appropriately decided based on experiments in consideration of the amount of clothes.

The laundry machine with the above-stated construction and the control method thereof has the following effects.

First, the present invention has the effect of effectively preventing or removing the wrinkles or rumples on an object to be dried, which has been dried. Also, the present invention has the effect of sterilizing the object and removing a smell from the object.

Secondly, the present invention has the effect of effectively removing the wrinkles or rumples from dried clothes without ironing.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A control method of a dryer, comprising:

supplying steam into a drum;

heating the interior of the drum before the step of supplying steam into the drum is carried out; and supplying hot air into the drum to dry clothes wetted by the steam, wherein the step of heating the interior of the drum includes supplying hot air, generated by a hot air heater, into the drum and operating the hot air heater to supply a less amount of heat than when operating to dry clothes wetted by the steam.

2. The control method according to claim 1, wherein the step of heating the interior of the drum includes operating the hot air heater for a predetermined period of time after the supply of water to a steam generator is completed or when a heater of the steam generator is turned on.

3. The control method according to claim 2, wherein the step of heating the interior of the drum includes operating the hot air heater when the water level in the steam generator reaches a high water level.

4. The control method according to claim 3, wherein the step of heating the interior of the drum includes stopping the operation of the hot air heater before the steam is supplied into the drum.

5. The control method according to claim 3, wherein the step of heating the interior of the drum includes stopping the operation of the hot air heater after the hot air heater is operated for a predetermined period of time.

6. The control method according to claim 3, wherein the step of heating the interior of the drum includes rotating the drum.

7. The control method according to claim 1, wherein the operating includes operating the hot air heater to generate lower strength of heat to supply the less amount of heat.

8. The control method according to claim 7, wherein the step of heating the interior of the drum includes stopping the operation of the hot air heater before the steam begins to be supplied into the drum.

9. The control method according to claim 7, wherein the step of heating the interior of the drum includes stopping the operation of the hot air heater after the hot air heater is operated for a predetermined period of time.

10. The control method according to claim 1, wherein the step of supplying steam, generated by a steam generator, into a drum includes rotating the drum.

11. The control method according to claim 10, wherein the drum is intermittently rotated.

12. The control method according to claim 11, wherein the stop time of the drum is greater than the rotation time of the drum.

13. The control method according to claim 1, further comprising:

cooling the drum.

14. The control method according to claim 13, wherein the supplying of steam includes generating steam by a steam generator and the control method further comprises collecting water remaining in the steam generator to discharge the remaining water to the outside after the supplying of steam is completed.

15. The control method according to claim 14, wherein the step of collecting water remaining in the steam generator includes pumping the remaining water in the steam generator to the outside.

16. The control method according to claim 1, wherein the steam supply time at the step of supplying steam into a drum and the hot air supply time at the step of supplying hot air into the drum to dry clothes wetted by the steam vary with a selected mode.

17. The control method according to claim 16, wherein the steam supply time and the hot air supply time for sterilization are greater than the steam supply time and the hot air supply time for removal of wrinkles.

18. The control method according to claim 16, wherein the steam supply time and the hot air supply time for fluffing are less than the steam supply time and the hot air supply time for removal of wrinkles.

19. The control method according to claim 15, wherein the operation of the pump is controlled based on the temperature of the remaining water in the steam generator.

* * * * *